US007722342B2

(12) United States Patent
Tsubono et al.

(10) Patent No.: US 7,722,342 B2
(45) Date of Patent: May 25, 2010

(54) PUMP APPARATUS AND POWER STEERING

(75) Inventors: Isamu Tsubono, Ushiku (JP); Mitsuo Sasaki, Hatano (JP); Toru Takahashi, Hiratsuka (JP); Masaaki Busujima, Atsugi (JP); Masakazu Kurata, Yokohama (JP); Yasuhito Nakakuki, Atsugi (JP)

(73) Assignee: Hitachi, Ltd., Tokyo (JP)

( * ) Notice: Subject to any disclaimer, the term of this patent is extended or adjusted under 35 U.S.C. 154(b) by 277 days.

(21) Appl. No.: 11/684,085

(22) Filed: Mar. 9, 2007

(65) Prior Publication Data

US 2007/0253855 A1 Nov. 1, 2007

(30) Foreign Application Priority Data

Apr. 27, 2006 (JP) ..... 2006-122877

(51) Int. Cl.
*F01C 1/02* (2006.01)

(52) U.S. Cl. ..... 418/61.3; 418/57

(58) Field of Classification Search ..... None
See application file for complete search history.

(56) References Cited

U.S. PATENT DOCUMENTS

| | | | | | |
|---|---|---|---|---|---|
| 3,460,481 | A * | 8/1969 | White, Jr. | ..... | 418/61.3 |
| 3,680,989 | A * | 8/1972 | Brundage | ..... | 418/71 |
| 3,695,791 | A * | 10/1972 | Brundage | ..... | 418/131 |
| 3,854,849 | A * | 12/1974 | Brille | ..... | 418/61.3 |
| 4,008,015 | A * | 2/1977 | McDermott | ..... | 418/61.3 |
| 4,549,862 | A * | 10/1985 | Stich et al. | ..... | 418/133 |
| 5,638,600 | A * | 6/1997 | Rao et al. | ..... | 29/888.02 |
| 6,378,206 | B1 * | 4/2002 | Minegishi et al. | ..... | 29/893.3 |
| 6,474,572 | B1 | 11/2002 | Tsuchiya et al. | | |
| 6,481,991 | B2 * | 11/2002 | Takagi et al. | ..... | 418/109 |
| 6,530,211 | B2 * | 3/2003 | Holtzapple et al. | ..... | 60/39.6 |
| 6,619,937 | B2 * | 9/2003 | Friedrichsen et al. | ..... | 418/61.3 |
| 6,895,855 | B2 * | 5/2005 | Doll | ..... | 92/72 |
| 7,163,162 | B2 | 1/2007 | Tsuchiya et al. | | |
| 7,467,934 | B2 * | 12/2008 | Thoms et al. | ..... | 418/61.3 |
| 2007/0075166 | A1 | 4/2007 | Tsuchiya et al. | | |

FOREIGN PATENT DOCUMENTS

| | | | | |
|---|---|---|---|---|
| JP | 2001-145661 A | | 5/2000 | |
| JP | 2001-289180 A | | 10/2001 | |
| JP | 2002145088 A | * | 5/2002 | ..... 418/66.3 |
| JP | 2005-41301 A | | 2/2005 | |

OTHER PUBLICATIONS

Chinese Office Action, Issued Jun. 6, 2008 (nine (9) pages).

* cited by examiner

*Primary Examiner*—Thomas Denion
*Assistant Examiner*—Douglas J. Duff
(74) *Attorney, Agent, or Firm*—Crowell & Moring, LLP

(57) ABSTRACT

In order to realize cost reduction in a gear pump apparatus by reducing form accuracy of a gear while securing pump performance, a running-in coating is provided on a tooth sliding contact portion when forming a confinement area in at least one of gears of the gear pump apparatus. By this feature, the running-in coating is gradually worn away and deformed according to rotary drive of the pump, and thus it is possible to obtain an optimal gear form in meshing combinations of the gears. Further, it is possible to reduce leakage inside the pump to secure the pump performance even if the form accuracy of the gear is reduced for the sake of the cost reduction.

5 Claims, 15 Drawing Sheets

PUMP APPARATUS AND POWER STEERING

BACKGROUND OF THE INVENTION

1. Field of the Invention

The present invention relates to a pump apparatus to be a hydraulic source of a hydraulic power steering for realizing steering of an automobile or the like, and in particular to the pump apparatus capable of suppressing leakage inside a pump and realizing high performance, and the power steering using the same.

2. Description of Related Art

As disclosed in JP-A-2005-41301, a conventional power steering gains a steering assisting force by selectively supplying oil pressure from a reversible pump apparatus driven by an electric motor to respective right and left cylinder chambers of a power cylinder. The reversible pump apparatus is an internal gear pump and realizes a bidirectional pumping action, in which a pump chamber is formed between an external gear which is rotatively driven and an internal gear which is engaged therewith, and its rotation direction is changed to change a moving direction of the pump chamber to counterchange a suction side and a discharge side so that supply of high pressure and low pressure can be appropriately changed.

BRIEF SUMMARY OF THE INVENTION

In a gear pump including the internal gear pump, in general, leakage of hydraulic oil from the discharge side to the suction side occurs, which causes reduction of pump efficiency. Particularly in the internal gear pump, the leakage of the hydraulic oil from the discharge side to the suction side occurs in a gear with a normal form accuracy, particularly when stopping rotation or slowly rotating, at a sliding contact portion of the external gear and the internal gear where a high pressure side and a low pressure side is separated, which causes reduction of the pump efficiency. To reduce the leakage, it is necessary to improve the form accuracy of the external gear and the internal gear. In the case of the internal gear pump, the meshing teeth of the external gear and the internal gear shift at each turn so that each tooth of the external gear and the internal gear gets meshed with all of the teeth of the other engaging gear. For this reason, it becomes necessary to significantly improve the form accuracy of the gears, which led to a significant increase in production cost. Further, when the rotation direction is reversed due to the reversible pump apparatus, a meshing position shifts to a surface facing an opposite direction even if the meshing tooth is the same, and thus a rotational phase relation between both gears is shifted by the amount of a backlash. Consequently, a location where those are slidingly in contact with each other varies according to the rotation direction, and the difference therebetween depends on a meshing backlash. Therefore, it has been very difficult to machine the gears while considering the sliding contact location which depends on the rotation direction in advance. Since the backlash of the gears requiring a seal varies, there has been a demand for a pump apparatus which can reduce the production cost while ensuring desired pump performance.

A first object of the present invention is to provide a pump apparatus which solves the above problem and the power steering on which the pump apparatus is mounted.

In addition, in the gear type pump, the two gears wear due to sliding contact during operation to improve mesh accuracy of the teeth. For this reason, the performance of the pump is gradually improved by operating it.

A second object of the present invention is to reduce the time to reach ultimate high performance.

The first object is attained by a first means in which at least one of a first gear and a second gear has a running-in coating in a portion where teeth of the first gear and the second gear are in sliding contact with each other at least in a confinement area where hydraulic oil is confined between the first gear and the second gear. Here, the running-in property is defined as a property of easily wearing by the sliding contact in comparison with a material on which it is provided.

Further, the second object is attained by providing, in addition to the first means, a biasing means for biasing at least one of the first gear and the second gear in a direction in which a contact force between a tip of the first gear and a tip of the second gear is improved, in the portion where the teeth of the first gear and the second gear are in sliding contact with each other in the confinement area.

Since a running-in processed portion gradually wears away and is deformed according to actual operation, it is possible to obtain optimal gear shapes in all mesh combinations of gears of the first gear and the second gear and to reduce leakage inside the pump to improve pump performance. This is especially effective in the case of a gear pump (represented by an internal gear pump) with different numbers of teeth where a tooth of an opposing gear to be meted with is different at each turn. It is also possible, by mutually biasing the gears, to promote the running-in and realize ultimate high performance in a short time.

Other objects, features and advantages of the invention will become apparent from the following description of the embodiments of the invention taken in conjunction with the accompanying drawings.

DETAILED DESCRIPTION OF THE INVENTION

Figure 1:
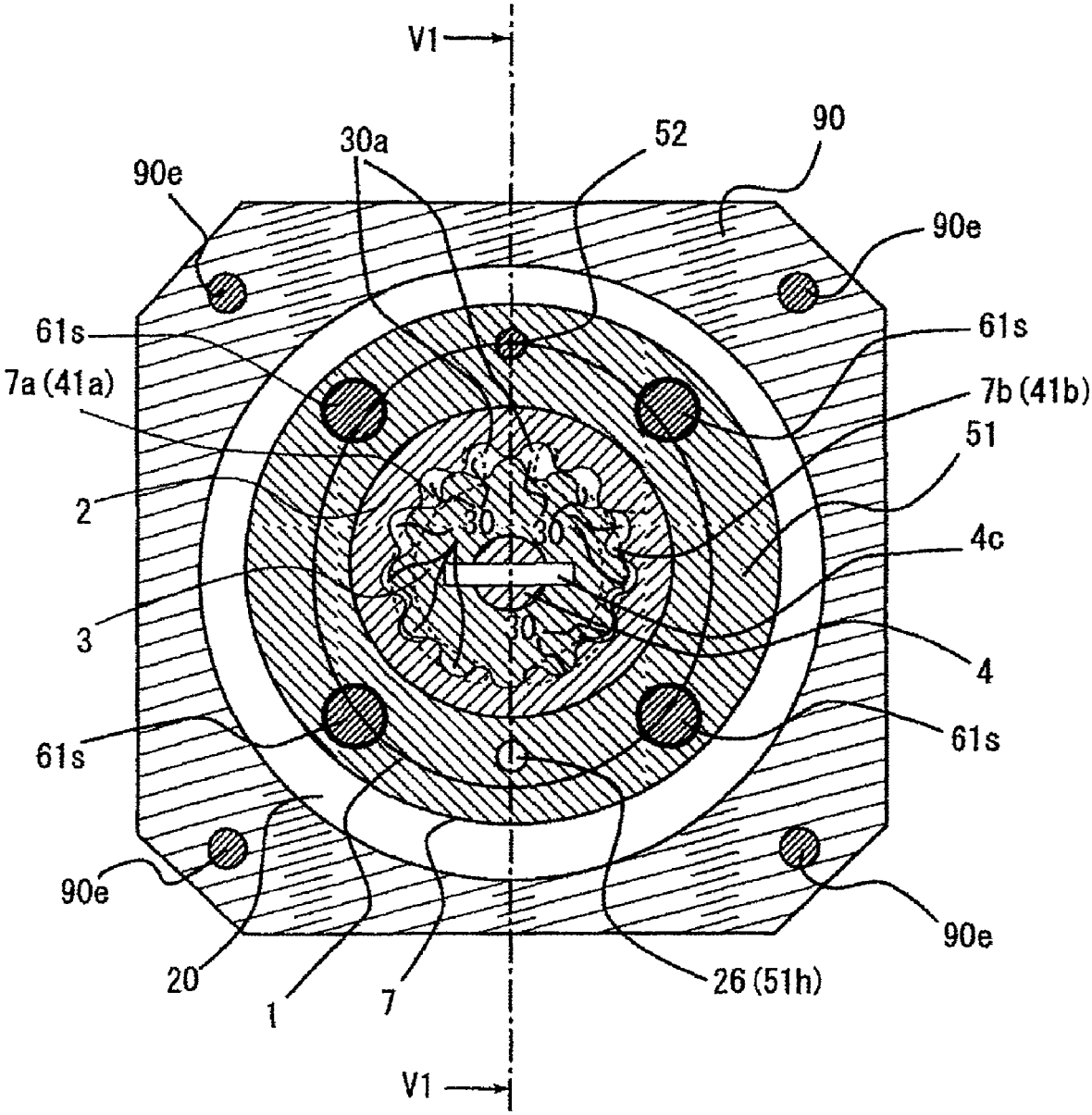
FIG. 1 is a transverse cross sectional view of a power pack internal gear portion according to a first embodiment (which is an H-H cross section of FIG. 2)

The present invention is preferable to application to a pump apparatus comprising: a housing; a first gear rotatably housed inside the housing; a second gear rotatably housed inside the housing and engaged with the first gear; a drive shaft for rotatively driving at least one of the first gear and the second gear; a suction port formed in the housing and opened in an area where hydraulic oil is sucked by rotation of the first gear and the second gear; and a discharge port formed in the housing and opened in an area where the hydraulic oil is discharged by the rotation of the first gear and the second gear.

Particularly, the present invention may be applied to an internal gear pump comprising: a housing; an internal gear rotatably housed inside the housing and having internal teeth on an inner periphery side; an external gear rotatably provided on the inner periphery side of the internal gear and having external teeth on an outer periphery side which external teeth are engaged with the internal teeth; a drive shaft connected to the external gear to rotatively drive the external gear; a suction port opened in a suction area where the capacity of a pump chamber is increased according to rotation of the drive shaft among multiple pump chambers formed between an internal teeth of the internal gear and the external teeth of the external gear; and a discharge port opened in a discharge area where the capacity of the pump chamber is decreased according to the rotation of the drive shaft among the multiple pump chambers.

Further, the present invention is suitable for application to a power steering comprising: a hydraulic cylinder for assisting a steering force of a steering mechanism (a rack-and-pinion and the like) linked to a steering wheel; a pump for supplying fluid pressure to a pressure chamber of the hydraulic cylinder; an electric motor for driving the pump; a steering torque detection means for detecting steering torque of the steering mechanism; and a motor control circuit for outputting a drive command signal to the electric motor based on the steering torque detected by the steering torque detection means, wherein the pump includes: a housing; an internal gear rotatably housed inside the housing and having internal teeth on an inner periphery side; an external gear rotatably provided on the inner periphery side of the internal gear and having external teeth on an outer periphery side which external teeth are engaged with the internal teeth; a drive shaft connected to the external gear to rotatively drive the external gear; a suction port opened in a suction area where the capacity of a pump chamber is increased according to rotation of the drive shaft among multiple pump chambers formed between the internal teeth of the internal gear and the external teeth of the external gear; and a discharge port opened in a discharge area where the capacity of the pump chamber is decreased according to the rotation of the drive shaft among the multiple pump chambers.

Hereinafter, a description will be given as to embodiments of the pump apparatus and the power steering to which the present invention is applied.

First Embodiment

Figure 2:
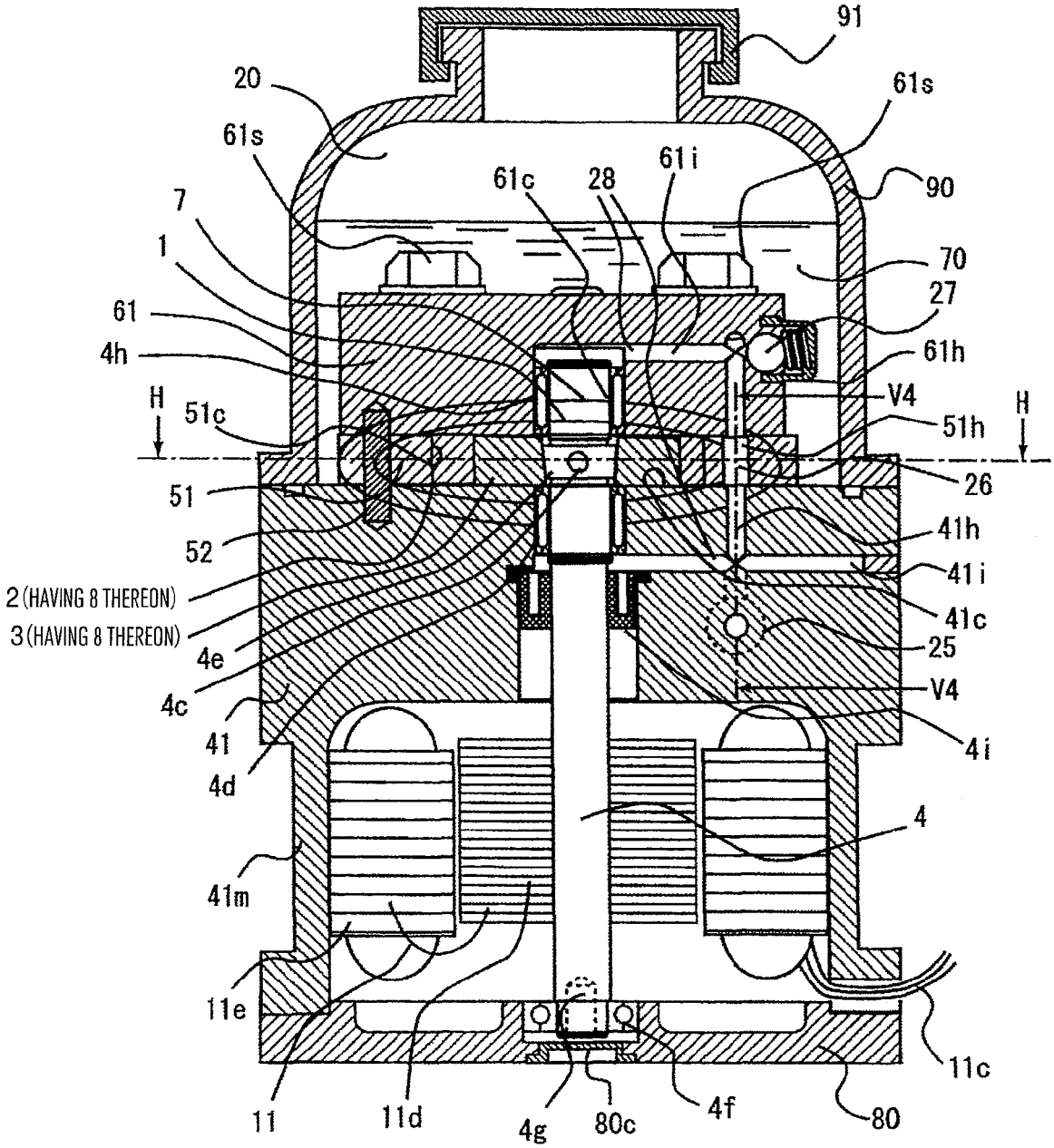
FIG. 2 is a longitudinal sectional view going through a motor shaft of the power pack according to the first embodiment (which is a V1-V1 cross section of FIG. 1)
Figure 3:
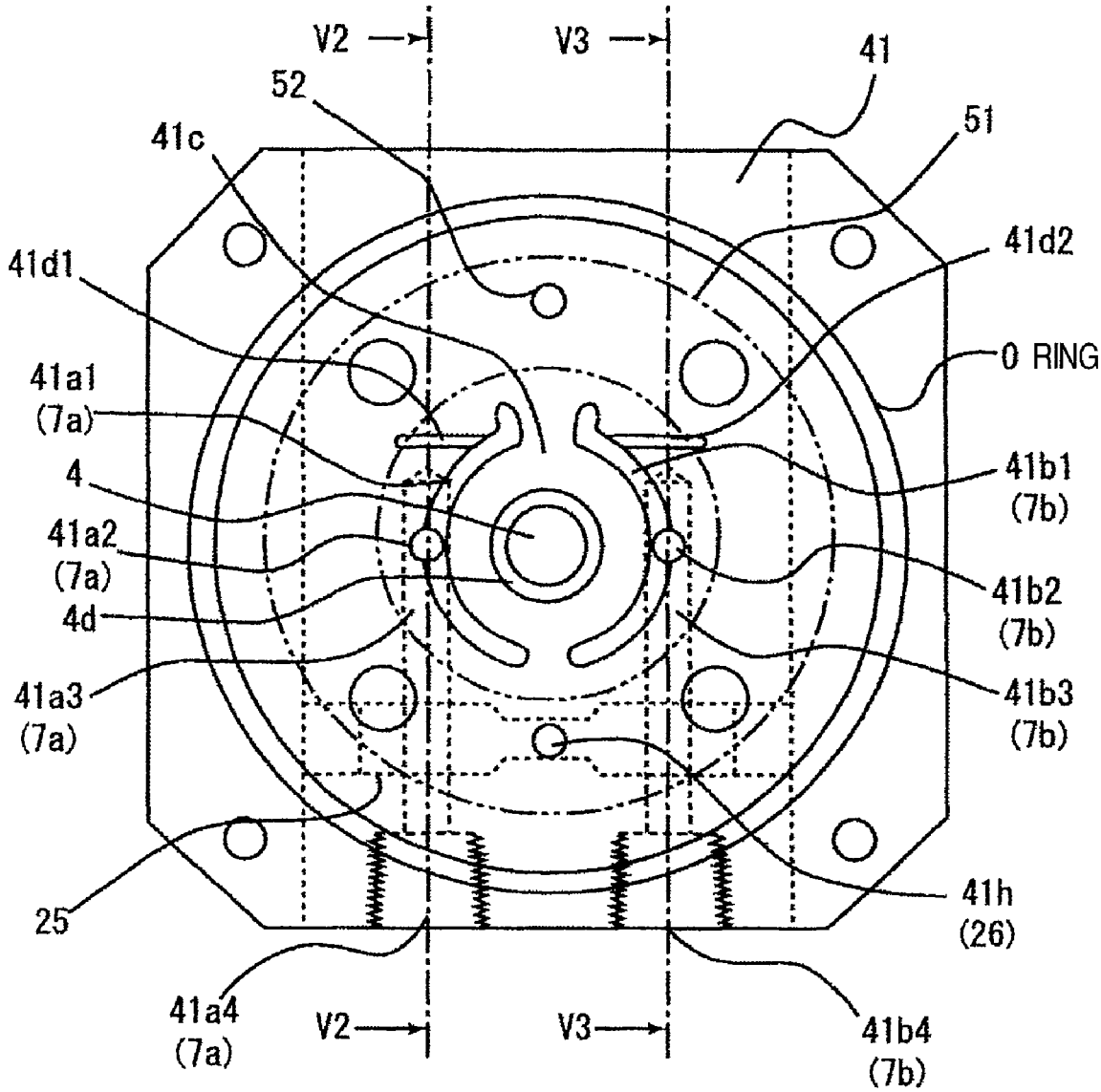
FIG. 3 is a plan view when internal gears and members placed above those of the power pack according to the first embodiment are removed (which is a casing top view)
Figure 4:
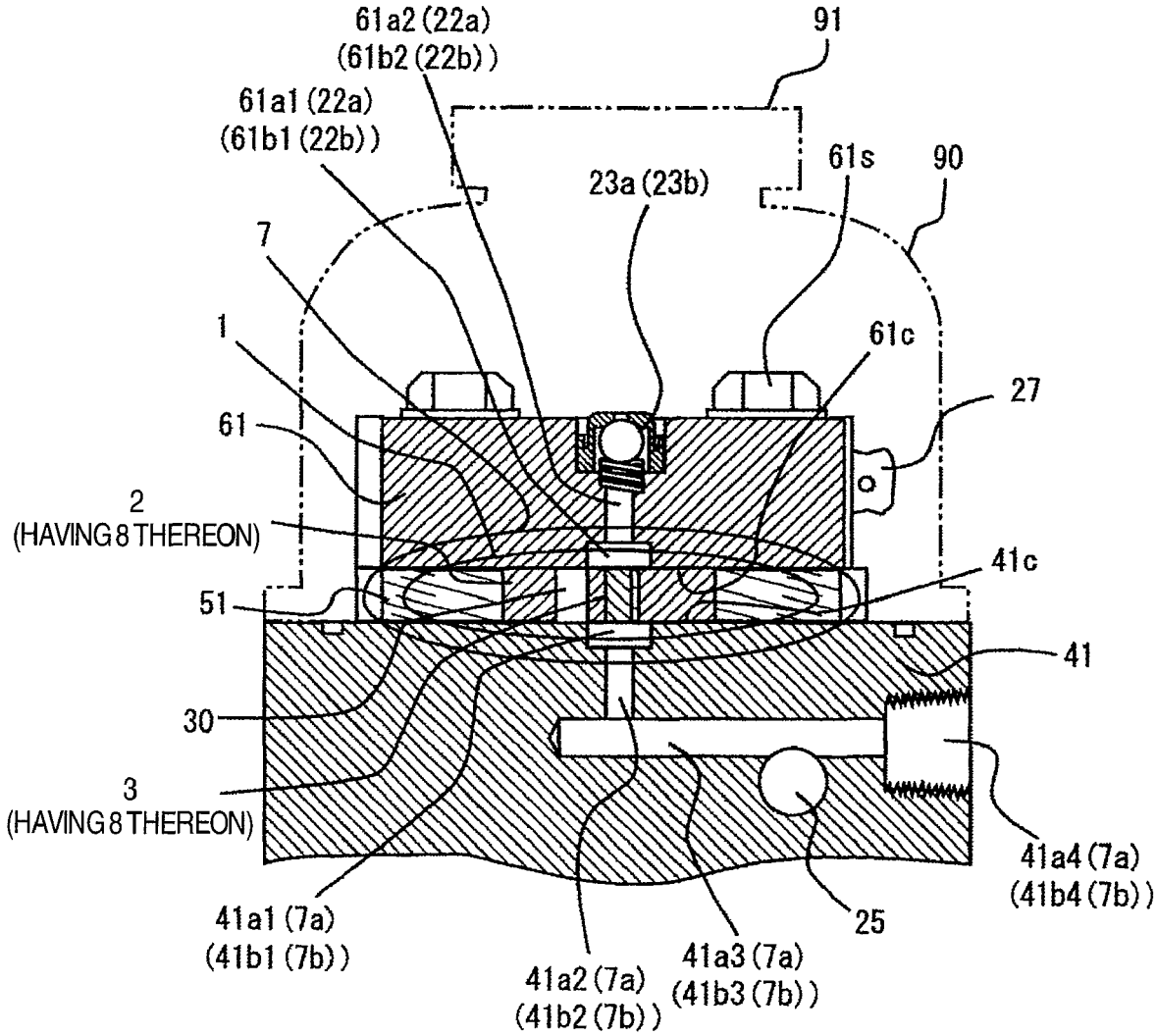
FIG. 4 is a longitudinal sectional view going through a first port and a second port of the power pack according to the first embodiment (which is a V2-V2 cross section or a V3-V3 cross section of FIG. 3)
Figure 5:
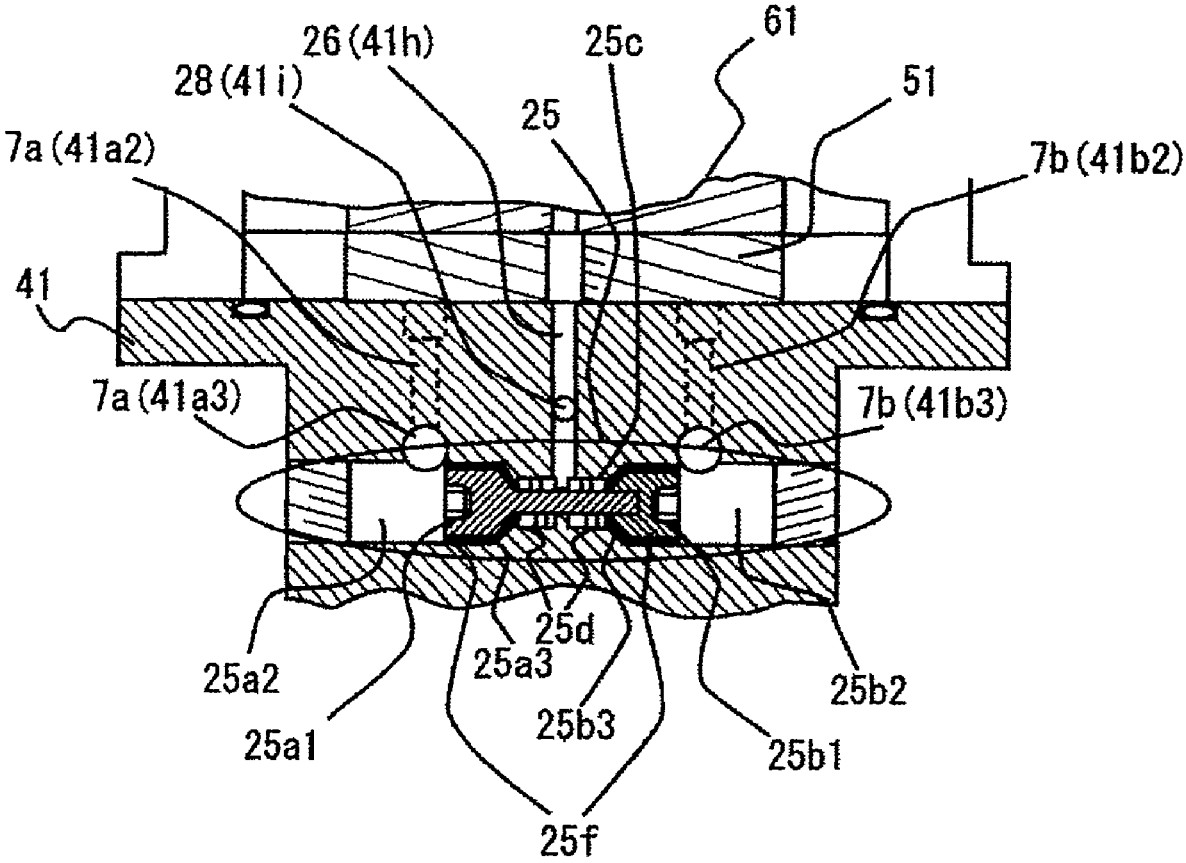
FIG. 5 is a longitudinal sectional view going through a discharge source switch valve of the power pack according to the first embodiment (which is a V4-V4 cross section of FIG. 2)
Figure 6:
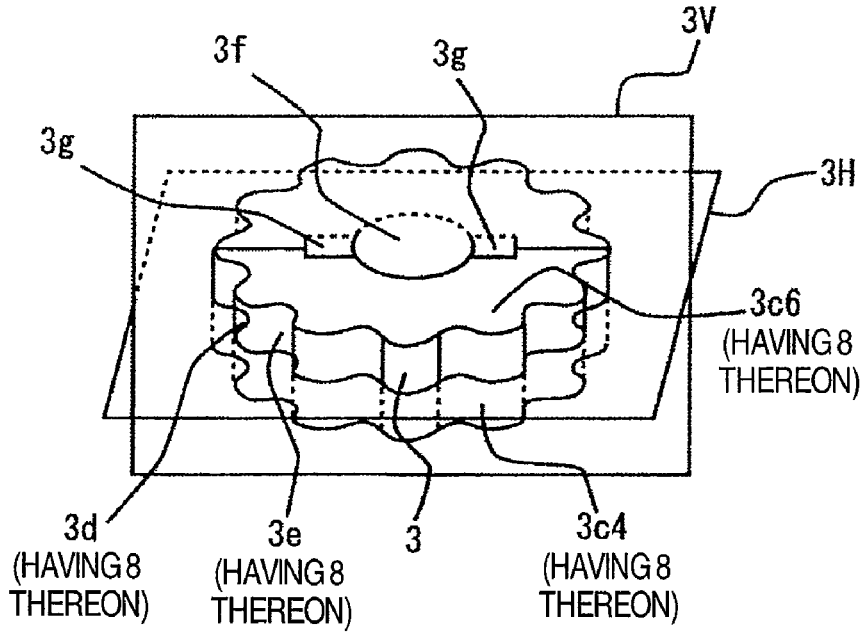
FIG. 6 is a perspective view of an external gear of the power pack according to the first embodiment.
Figure 7:
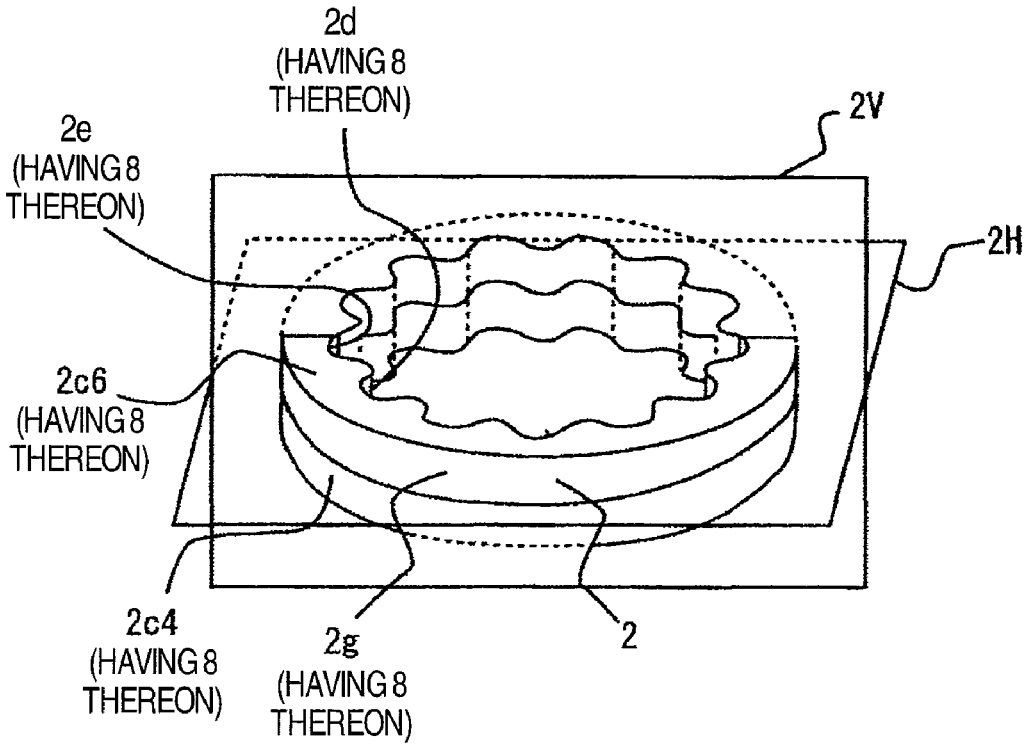
FIG. 7 is a perspective view of an internal gear of the power pack according to the first embodiment.
Figure 8:
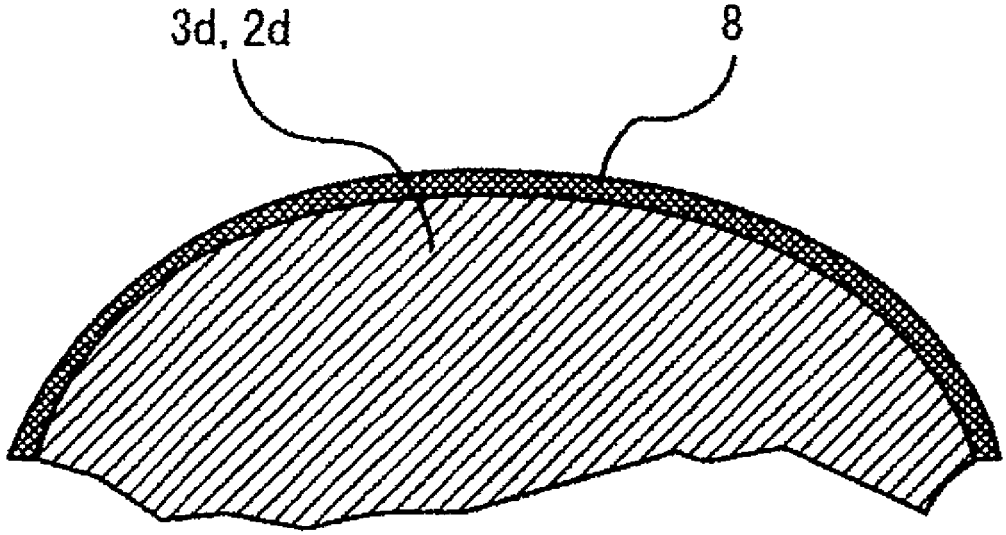
FIG. 8 is an enlarged view of a tooth tip portion in the transverse cross section (a 3H cross section of FIG. 6 or a 2H cross section of FIG. 7) of the external gear or the internal gear of the power pack according to the first embodiment.
Figure 9:
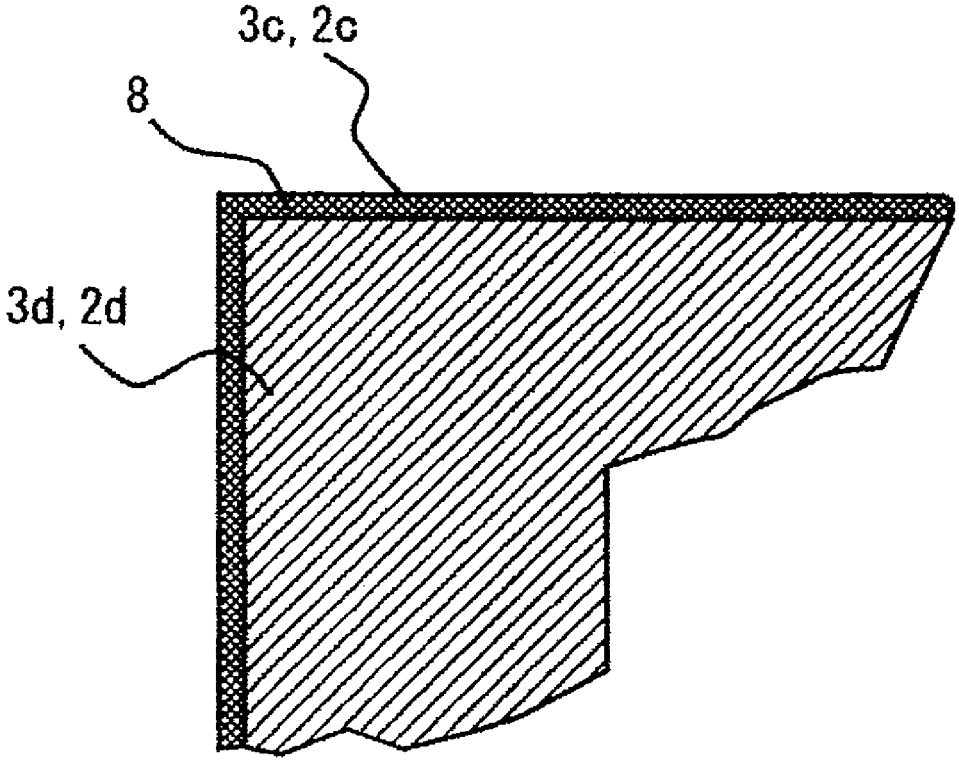
FIG. 9 is an enlarged view of a tooth corner portion in the longitudinal section (a 3V cross section of FIG. 6 or a 2V cross section of FIG. 7) of the external gear or the internal gear of the power pack according to the first embodiment.
Figure 10:
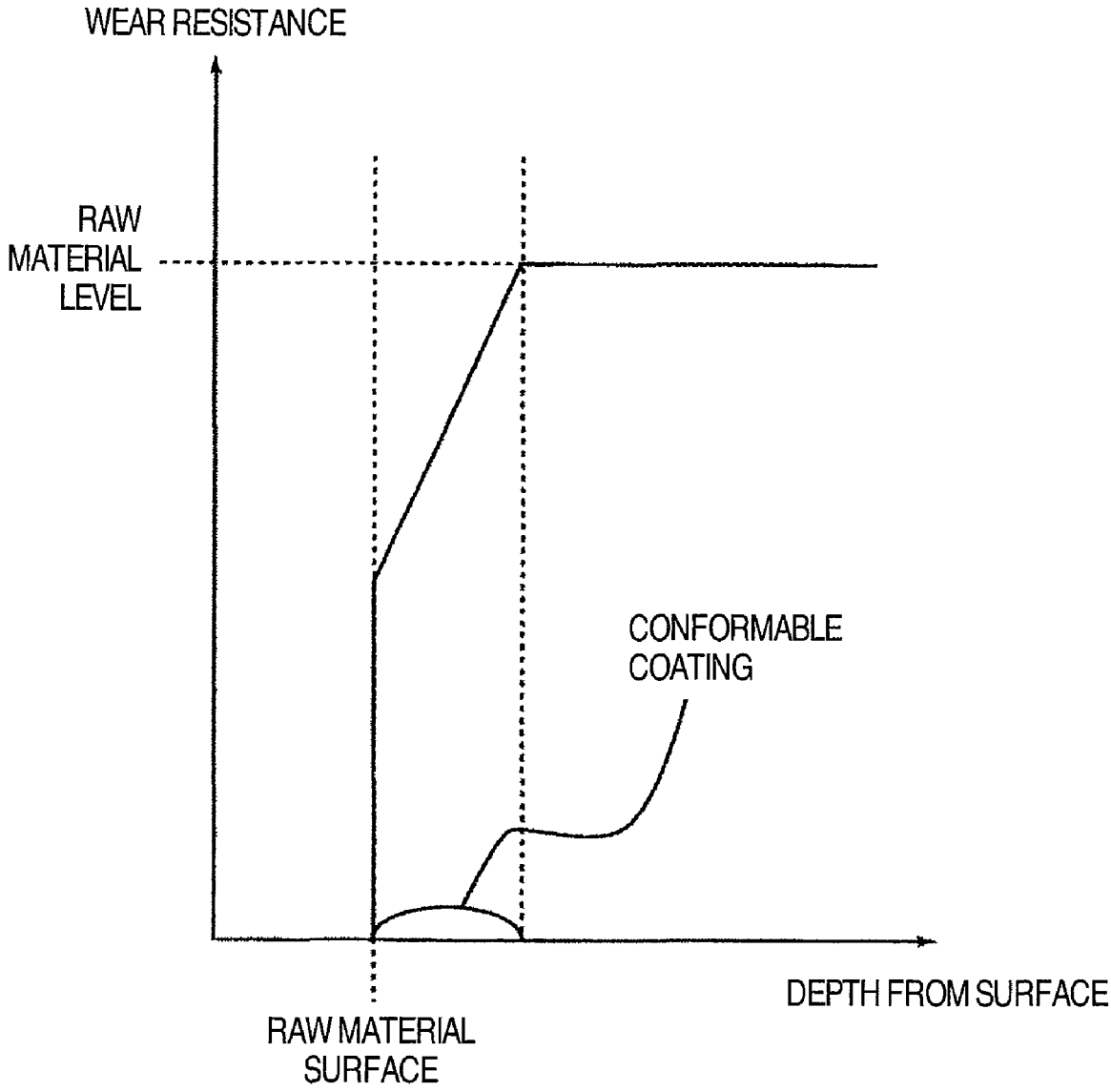
FIG. 10 is an explanatory diagram of wear resistance of a running-in coating provided on a surface of the external gear or the internal gear of the power pack according to the first embodiment.
Figure 11:
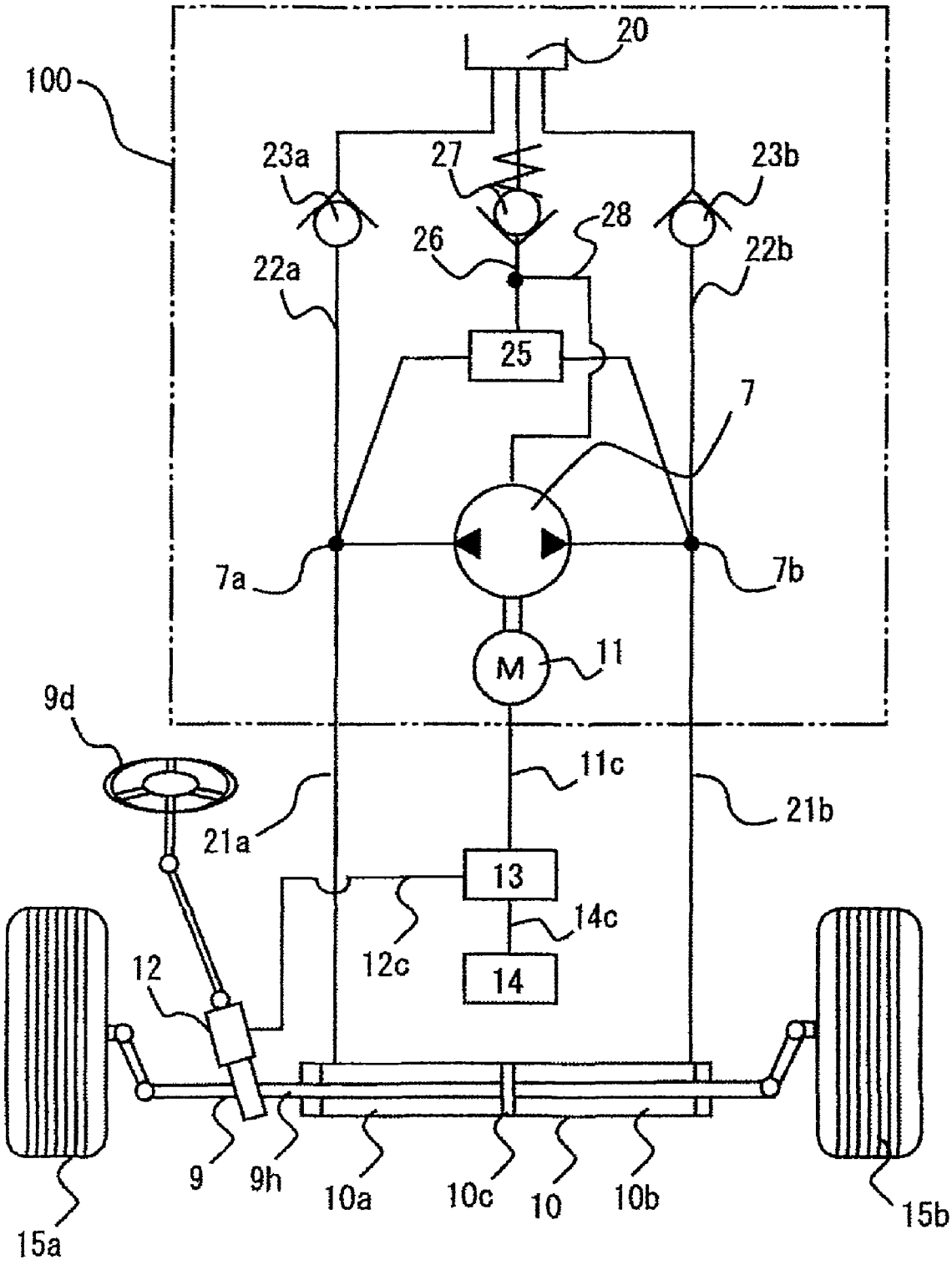
FIG. 11 is a system configuration diagram of the power steering according to the first embodiment.
Figure 12:
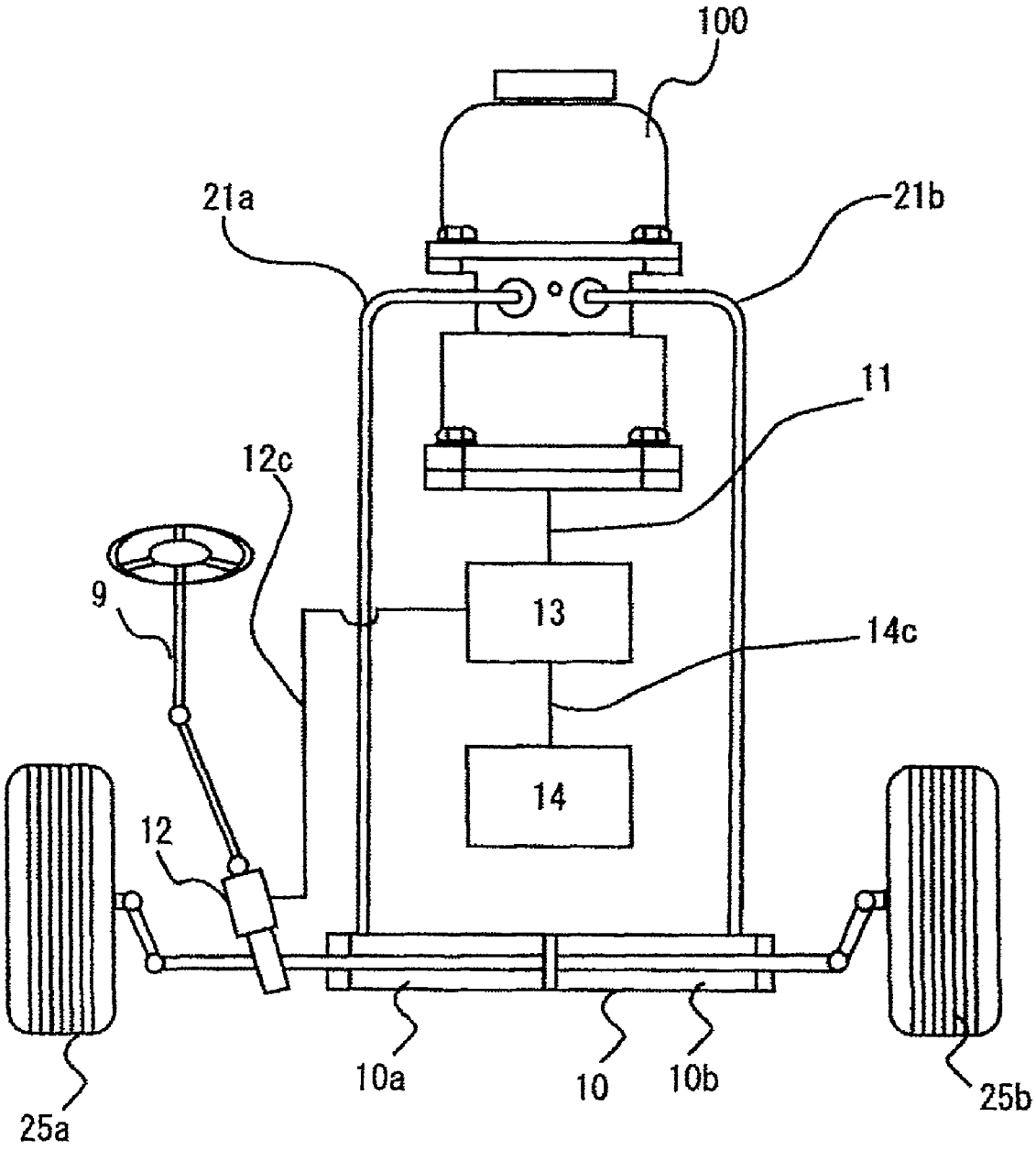
FIG. 12 is a system configuration diagram of an actual form of the power steering according to the first embodiment.
Figure 13:
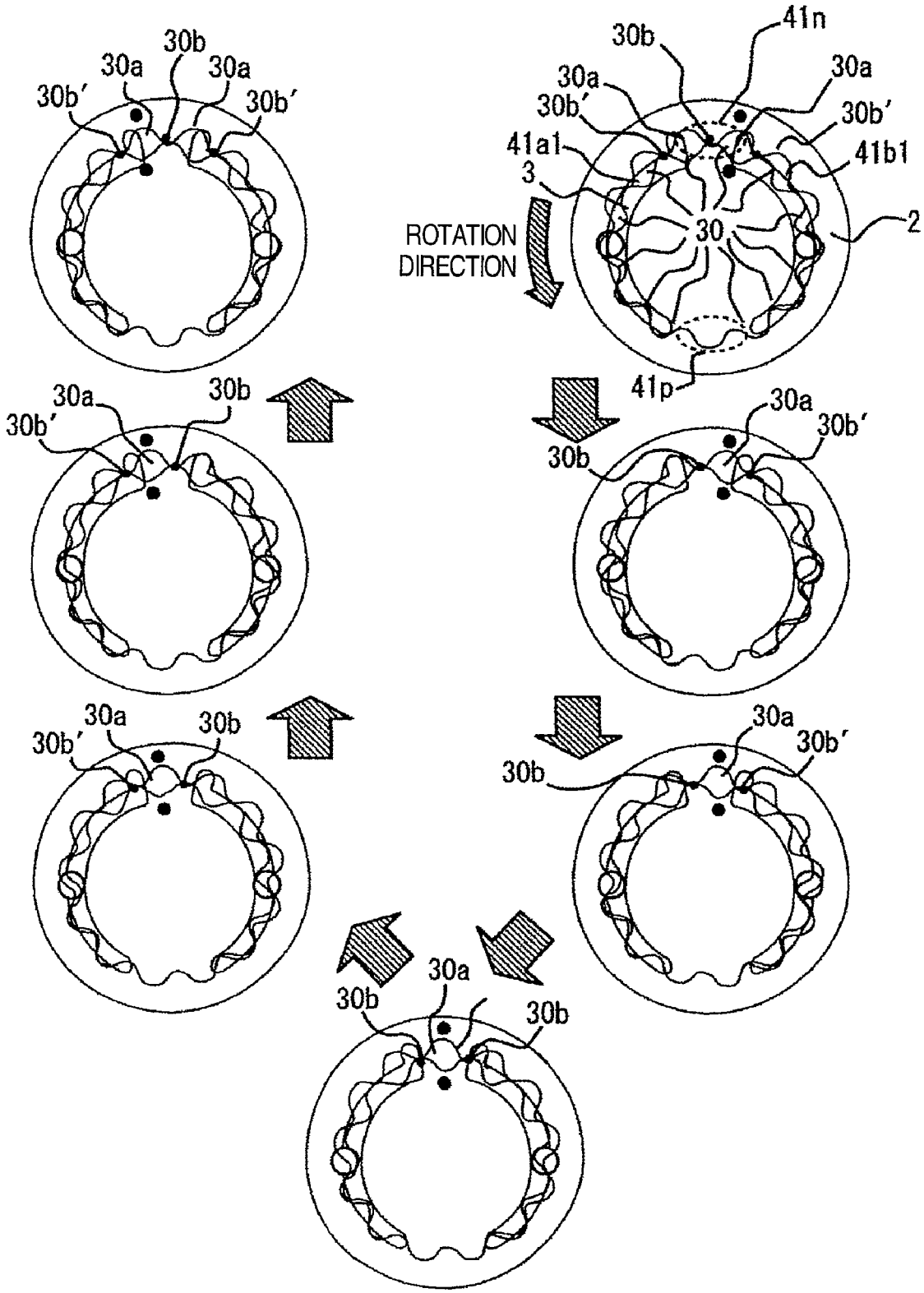
FIG. 13 is an explanatory diagram of gear meshing operation the power pack according to the first embodiment.

A description will be given as to a first embodiment of the pump apparatus and the power steering on which the pump apparatus is mounted according to the present invention, based on FIGS. 1 to 13. The type of the pump is an internal gear type and is a reversible pump which drives an electric motor bi-directionally, FIG. 1 is a cross sectional view of an internal gear portion (an H-H cross section of FIG. 2), FIG. 2 is a longitudinal sectional view going through a motor shaft (a V1-V1 cross section of FIG. 1), FIG. 3 is a plan view when internal gears and members placed above those are removed (a casing top view), FIG. 4 is a longitudinal sectional view going through a first port and a second port (a V2-V2 cross section or a V3-V3 cross section of FIG. 3), FIG. 5 is a longitudinal sectional view going through a discharge source switch valve (a V4-V4 cross section of FIG. 2), FIG. 6 is a perspective view of an external gear, FIG. 7 is a perspective view of an internal gear, FIG. 8 is an enlarged view of a tooth tip portion in the transverse cross (a 3H cross section of FIG. 6 or a 2H cross section of FIG. 7) section of the external gear or the internal gear, FIG. 9 is an enlarged view of a tooth corner portion in the longitudinal section (a 3V cross section of FIG. 6 or a 2V cross section of FIG. 7) of the external gear or the internal gear, FIG. 10 is an explanatory diagram of wear resistance of a running-in coating, FIG. 11 is a system configuration diagram of the power steering, FIG. 12 is a system configuration diagram reflecting an actual form, and FIG. 13 is an explanatory diagram of gear meshing operation.

The pump apparatus is the most important component of the power steering, however, there are also several other indispensable components (see FIG. 11), and the pump apparatus of this embodiment takes a form integrated with some of the indispensable components (called as a power pack). Thus, as order of describing the pump apparatus of this embodiment, after describing a power steering having a pump apparatus 7 mounted thereon on the basis of FIGS. 11 and 12, a power pack 100 having the pump apparatus 7 incorporated therein will be described according to FIGS. 1 to 10, and lastly, a detailed description mainly of operation of the pump apparatus 7 will be given while including FIG. 13.

The power steering will be described. The components of the power steering are a steering mechanism 9 starting from a rack rod 9*h* connecting right and left steering wheels 15*a*, 15*b* to a steering wheel 9*d* giving a translatory amount thereof as a rotation amount, a cylindrical hydraulic cylinder 10 placed around the rack rod 9*h* and generating a steering assisting force, a steering torque detection means (steering torque sensor) 12 for detecting the steering assisting force as a rotary torque, a motor control circuit 13 for controlling electric power supplied from a power supply 14 to an electric motor 11 on the basis of a torque signal from the steering torque detection means 12 (via a signal line 12*c*) (a power line between the motor control circuit 13 and the electric motor 11 is called as a motor line 11*c*, and the power line between the motor control circuit 13 and the power supply 14 is called as a power wire 14*c*), and a hydraulic supply system for supplying oil pressure to a first hydraulic chamber 10*a* and a second hydraulic chamber 10*b* into which the hydraulic cylinder 10 is divided by a piston 10*c* fixed on the rack rod 9*h* in right and left directions. The hydraulic supply system as a component lastly raised includes a hydraulic circuit which connects the two hydraulic chambers 10*a* and 10*b* via the bidirectional pump apparatus 7 as a basic configuration. A pump connection location of a first hydraulic circuit 21*a* for connecting the first hydraulic chamber 10*a* with the pump apparatus 7 is called a first port 7*a*, and the others are called as a second hydraulic circuit 21*b* and a second port 7*b*, respectively. These ports become the discharge ports or the suction ports depending on the rotation direction of the electric-motor 11. These hydraulic circuits are provided with refueling circuits 22*a*, 22*b* connected from a reservoir tank 20 opened in the air to the ports 7*a* and 7*b* via suction valves 23*a*, 23*b* which are one-way valves. Those bear a part in supplying oil (called as hydraulic oil 70 hereinafter) from the reservoir tank 20 in the case where the amount of the oil is insufficient in the hydraulic circuits 21*a* and 21*b*. On the other hand, an oil-drain circuit 26 is provided for the sake of draining the hydraulic oil from the ports 7*a* and 7*b* to the reservoir tank 20 in the opposite direction to this. In the middle of this circuit, a discharge valve 27 is provided for the sake of keeping the inside of the circuit at a pressure higher than the pressure (air pressure) inside the reservoir tank 20 which is a discharge destination. As the oil-drain circuit 26 bear a part in keeping the suction side at the above described pressure, a discharge source switching valve 25 is provided upstream the oil-drain circuit 26 for selecting and connecting a port to be on the suction side among the two ports 7*a* and 7*b*.

Among the components described above (see FIG. 11), the components integrated and enclosed by a two-dot chain line is the power pack 100, which includes all hydraulic system parts except the hydraulic cylinder 10 which is an output part and associated with the steering mechanism, and the electric motor 11 which is a driving source thereof. To be more specific, the power pack 100 exclusively plays the main role of a steering system wherein, if the electric power is supplied by the power line 11*c*, it supplies the hydraulic oil from the first hydraulic circuit 21*a* and the second hydraulic circuit 21*b* to the hydraulic chambers 10*a*, 10*b* or sucks it out from the hydraulic chambers 10*a*, 10*b* so as to be in conformity with the steering operation under various circumstances. For this reason, the actual steering takes a very simple form as shown in FIG. 12. In the case of detecting the number of revolutions and the like of the electric motor 11, a detecting element in the electric motor 11 and a signal line for transmitting a signal therefrom to the motor control circuit 13 are added. Similarly, in the case where a detector is provided to each portion to grasp the condition of the steering, a signal line for connecting it to the motor control circuit is also added.

Next, the power pack 100 will be described. Main components of the power pack are the pump apparatus 7 and the electric motor 11. In the normal cases, the electric motor 11 and the pump apparatus 7 are separately assembled, and the shafts of those are lastly connected by a coupling (an Oldham's coupling or the like which allows eccentricity) and tightened by a screw or the like. As for the present invention, however, the number of parts is significantly reduced by integrally incorporating the electric motor 11 into the pump apparatus 7 to control the costs. Further, the other components of the power pack 100 (such as the discharge source switching valve 25 and the suction valves 23) are incorporated into some of the pump component parts to be in a compact form as a whole. For this reason, a description will be given first as to the configuration of the pump apparatus 7 which is integrated with the electric motor 11 as a main component. Thereafter, the configuration of the other elements incorporated into the component parts will be described.

A drive shaft 4 is fitted in a state where a needle type lower bearing 4*d* is placed in an upper part of a center through hole of a housing base 41 with a shaft seal 4*i* placed in its lower part and an external gear 3 (having a running-in coating 8 on the surface except a central hole portion) is passed from the above side of the hole. In this case, a baffle pin 4*c* is pressed into the drive shaft 4 in advance so as to be inserted into a baffle groove 3*g* of the external gear 3. Here, as shown in FIG. 2, a center hole 3*f* of the external gear (see FIG. 6) and a gear supporting portion 4*e* of the drive shaft 4 are in a tapered shape. Therefore, it is possible, by pulling the drive shaft 4 downward, to realize highly accurate center matching with no backlash between the drive shaft 4 and the external gear 3 and biasing of the external gear 3 to a housing bottom 41*c*.

Next, a rotor 11*d* is pressed into the drive shaft 4 protruding in the lower part of the shaft seal 4*i* to form a stator 11*e* and the electric motor 11 which are fixedly placed in advance on an inner surface of a housing cylinder portion 41*m* extended below the housing base 41. A bottom cover 80 is positioned by fitting on an undersurface of the housing cylinder portion 41*m* and fixed by a screw (a tightening screw is not shown). A lower-end bearing 4*f* is fitted into the hole at the lower end of the drive shaft 4 and the center of the bottom cover 80. Here, it is possible to turn a cylindrical plane on the center side for fitting the lower-end bearing 4*f* and the cylindrical plane on the outer edge side for mutually fitting the housing cylinder portion 41*m* of the bottom cover 80 with the same chucking, so that central axes of both cylindrical planes can secure high coaxial accuracy. Similarly, high coaxiality can be realized by the cylindrical plane on the top center side for fitting the lower bearing 4*d* and the cylindrical plane of the lower end of the housing cylinder portion 41*m* for mutually fitting the bottom cover 80 on the housing base 41.

As described above, very high accuracy can be secured as to inside diameter coaxiality of the lower bearing 4*d* and the lower-end bearing 4*f* which are significantly separate in an axial direction. Therefore, it is possible to suppress a displacement between the drive shaft 4 axially supported by those and each of the bearings 4*d* and 4*f* in the central axis direction to a significantly small value. Consequently, there is the effect of suppressing losses generated on both bearings and improving pump performance.

As shown in FIG. 2, the rotor 11*d* is set in a position which is a little higher than the position of the stator 11*e* in the axial direction so that an axial thrust for pulling the drive shaft 4 downward is generated. It is thereby possible, due to the tapered shape of the center hole 3*f* of the external gear and the gear supporting portion 4*e* of the drive shaft 4, to realize the highly accurate center matching with no backlash between the drive shaft 4 and the external gear 3 and the biasing of the external gear 3 to a housing bottom 41*c*. Here, in the case where the rotor or the stator is a type including a permanent magnet, there is a possibility that a sucking force works between those and causes difficulty in assembly. In this case, it is possible to pass a current to a winding wire of the other so as to polarize it with a magnetic field thereof after assembly.

Next, a housing case 51 is placed on the housing base 41 while inserting one locating pin 52 pressed into the housing base 41 in advance into a corresponding hole, and then an internal gear 2 (having the running-in coating 8 on the surface) is inserted between a housing inner periphery plane 51*c* thereof and the external gear 3 (see FIG. 1). In addition, a housing cover 61 is further placed thereon by approximately positioning it with the locating pin 52. Thereafter, the drive shaft 4 is rotated at the order of a hand-turning speed by energizing the electric motor 11 or rotating a taper pin pushed into a lower-end hole 4*g* at the lower end of the drive shaft 4 with another rotation source. In this state, a cover screw 61*s* is gradually fastened while monitoring a rotary torque by a motor current or the like and fine-tuning the position of each of the parts so as not to exceed a desired threshold.

Thus, it is possible to fixedly place the housing case 51 and the housing cover 61 at an adequate position with respect to the housing base 41.

Here, an object of the locating pin 52 is rotational positioning of the housing case 51 and the housing cover 61 with the drive shaft 4 being centered. Therefore, it is even better to render locating pin holes of the housing case 51 and the housing cover 61 elongate-hole-shaped with those long axes in a radial direction orthogonal to the rotation direction.

In this manner, internal space combining the housing bottom face 41*c*, the housing periphery plane 51*c* and a housing top surface 61*c* (called as a housing 1 hereinafter) is formed inside a combination of the three housing members 41, 51 and 61 so as to house the external gear 3 and the internal gear 2 therein.

On the housing bottom face 41*c*, two port grooves (first port groove 41*a*1, second port groove 41*b*1) as clearly shown in FIG. 3 are formed. Those are connected with two port horizontal holes (first port horizontal hole 41*a*3, second port horizontal hole 41*b*3) inside the housing base shown in FIG. 4 by port vertical holes (first port vertical hole 41*a*2, second port groove 41*a*2) so as to form a first port 7*a* and a second port 7*b* communicated to the pump chamber formed between the gears described later.

Here, the port grooves 41*a*, 41*b* have the dimensions wherein peripheries thereof are located further inside than the tooth tips of the external gear 3, and therefore, the tooth tips of the external gear no longer get in the port grooves so that inclination of the external gear can be controlled, the rotation of the gear is stabilized and its stagger is suppressed and seal properties of seal portions are improved. Consequently, there is the effect of improving the pump performance. As the rotation of the external gear can be stabilized, it is possible to reduce collisions with the internal gear, the housing bottom and the top surfaces 41*c*, 61*c* and lessen oscillation noise during operation.

These ports are opened as screw holes (called as a first port hole 41*a*4 and a second port hole 41*b*4) on a side of the housing base. The pump apparatus 7 of an internal gear type which is integrated with the electric motor 11 is formed as above.

Next, a description will be given as to the configuration and operation of the other elements of the steering system incorporated into the power pack 100.

First, the configuration of the reservoir tank 20 will be described. A dome-shaped upper cover 90 having an upper cap 91 mounted by sandwiching an O ring is tightly fixed in the upper part of the housing base 41. By this, closed space is formed in the upper part of the housing base 41 in the state of surrounding the peripheries of the housing case 51 and the housing cover 61. The reservoir tank 20 is formed by letting the hydraulic oil 70 into this space from the upper cap 91.

Next, a description will be given as to the oil-drain circuit 26, the discharge source switching valve 25 for switching a circuit entrance thereof, and discharge valve 27. The oil-drain circuit 26 is the circuit for discharging the hydraulic oil from the port which is at a relatively low pressure to the reservoir tank 20 in order to coercively reduce the pressure of the port which is at a relatively low pressure out of the first port 7*a* and second port 7*b* to a certain low pressure value. For this reason, it is essential for the circuit entrance to have the switching valve for selecting the port which is at a relatively low pressure out of the first port 7*a* and second port 7*b* and communicating therewith. This valve is the discharge source switching valve 25. The discharge source switching valve 25 will be described first based on FIGS. 3 and 5. As for the discharge source switching valve 25, end faces of switching valve elements 25*a*1, 25*b*1 face port spaces 25*a*2, 25*b*2 communicated with both ports 7*a* and 7*b* respectively, and the other ends are valve seats of a tapered shape (first changeover valve seat 25*a*3, second changeover valve seat 25*b*3). Then, those have a neutral positioning compression spring 25*d* placed in the central space for performing neutral positioning, and are coupled by a switching valve element coupling rod 25*c*. Here, an end of a base discharge hole 41*h* to be the oil-drain circuit 26 is opened in the space (around the coupling rod) for housing the neutral positioning compression spring 25*d*.

Next, a description will be given as to the operation of the discharge source switching valve 25 of the above configuration. For instance, consideration is given to the case where the first port 7*a* is at a relatively lower pressure than the second port 7*b*. In this case, the first port space 25*a*2 is at a lower pressure than the second port space 25*b*2, and so the integrated switching valve elements move to the first port space 25*a*2 side so that the second switching valve seat 25*b*3 closes and the first switching valve seat 25*a*3 opens. To be more specific, the oil-drain circuit 26 communicates with the first port 7*a* which has been at a relatively low pressure. It obviously communicates with the second port 7*b* in the case where the port pressures are reverse to this.

As described above, it has become clear that the discharge source switching valve 25 constantly performs the operation required as an element of the system for connecting an upstream side (discharge source) of the oil-drain circuit 26 to the port on a low pressure side.

The oil-drain circuit 26 is formed by connecting the base discharge hole 41*h*, a case discharge hole 51*h* and further a cover discharge hole 61*h*, and has the discharge valve 27 composed of the compression spring and the valve body element (spherical this time) provided on its downstream side (see FIG. 2). For this reason, the pressure in the oil-drain circuit 26 is kept at a fixed value in which a value equivalent to an elastic force of the compression spring is added to the air pressure (pressure in the reservoir tank 20). The pressure of the port on the low pressure side can be constantly kept at a fixed value higher than the air pressure prescribed by the discharge valve by the operation of the oil-drain circuit 26, the discharge valve 27 and the discharge source switching valve 25.

As the ports 7*a* and 7*b* are connected to the hydraulic circuits 21*a* and 21*b*, those consequently show the operation for constantly keeping the pressure on the low pressure side of the hydraulic cylinder 10 at a fixed pressure higher than the air pressure. This has the effect of improving steering stability and steering assisting response against a kickback from a road surface due to reduction in the stagger of the hydraulic cylinder when giving no steering assist and improvement in operational response of the hydraulic cylinder when giving the steering assist.

Those also play a role so that, in the case where the hydraulic chamber on the high pressure side pushes the cylinder piston 10*c* into the other hydraulic chamber on the low pressure side when the pump apparatus 7 causes high-speed rotation on giving drastic steering assist, the pressure of the hydraulic chamber on the low pressure side is prevented from rising despite one's intention by discharging to the reservoir tank 20. This has the effect of improving steering follow-up on sudden inversion of the steering direction and steering feeling in conjunction therewith.

Next, a description will be given as to the configuration and operation of the refueling circuits 22*a*, 22*b* for replenishing the hydraulic oil 70 from the reservoir tank 20 to both ports 7*a* and 7*b* and the suction valves 23*a*, 23*b* mounted thereon respectively, based on FIG. 4. The refueling circuits 22*a*, 22*b* are composed of refueling grooves 61*a*1, 61*b*1 of the same shape as the port grooves 41*a*1, 41*b*1 (of the same planar shape as the port grooves 41*a*1, 41*b*1 while the groove depth may be shallower) provided on a bottom face of the housing cover 61 (housing top surface 61*c*) and refueling vertical holes 61*a*2, 61*b*2 passing through those and vertically penetrating the housing cover 61. On upper ends thereof, refueling valves 23*a*, 23*b* composed of the vale element (spherical this time) and a weak spring capable of lifting it to the valve seat are provided. The refueling valves are the one-way valves from the reservoir tank 20 to the pump apparatus side, and are capable of promptly supplying the hydraulic oil to the port on the low pressure side where negative pressure is generated due to delay in movement of the piston 10*c* of the hydraulic cylinder 10 on sudden turn of the steering. Therefore, those have the effect of improving the steering follow-up and steering feeling in conjunction therewith.

Next, a description will be given as to a bearing oil-drain path 28 based on FIG. 2 and further with reference to FIG. 11. The bearing oil-drain path 28 is composed of an upper bearing refueling hole 61*i* (placed on the housing cover 61) provided on the housing cover 61 and a lower bearing refueling hole 41*i* (placed on the housing base 41) provided on the housing base 41, which connect the opposite sides to the housing of bearings 4*h*, 4*d* with the oil-drain circuit 26 respectively.

On the bearing side of both ends thereof, the hydraulic oil leaks out of clearances of various parts of the gears 2, 3 from the pump chamber on the high pressure side, and the oil-drain circuit 26 of the other end is constantly kept at the lowest pressure in the entire hydraulic system (except the reservoir tank 20) of the steering as previously described. Therefore, this oil passage constantly generates an oil flow in which the hydraulic oil leaked from a pump chamber 30 heads for the oil-drain circuit 26. To be more specific, the two bearings are constantly fed so that there is the effect of improving pump efficiency due to improvement in reliability of the bearings and reduction in bearing loss.

The oil flow also has a lubricating action by going through the sides of the gears 2, 3 and a sliding portion on the periphery of the internal gear 2 so that there is the effect of improving the pump efficiency due to improvement in reliability of the gears 2, 3 and reduction in sliding loss.

The lower bearing refueling hole 41*i* also plays a role of reducing the pressure exerted on the shaft seal 4*i* so as not to leak the hydraulic oil on the electric motor 11 side in the open air.

As shown in FIG. 2, the shaft seal 4*i* generates a sealing action by introducing high pressure inside a U-shaped cross-section. As the introduced pressure can be rendered adequate by the lower bearing refueling hole 41*i*, there is the effect of improving the pump efficiency by reduction in sliding loss of the shaft seal portion. As a matter of course, reliability of the shaft seal is also improved.

The above described an overview of the configuration and the operation of the steering. Next, a description will be given by using FIG. 13 as to the operation of the pump apparatus 7 which is directly related to the present invention. FIG. 13 is a diagram showing a mesh state while the external gear 3 proceeds by one tooth, by dividing it into six stages.

The pump apparatus 7 is the internal gear pump wherein the external gear 3 is engaged with the internal gear 2 having one more tooth than that by decentering those to separately form multiple pump chambers 30 between those, and the external gear 3 is rotatively driven with the internal gear 2 driven to follow it to move among the pump chambers while changing the capacity so as to suck a fluid from one of the ports provided in the housing 1 and discharge it from the other port. It is possible to separately form multiple pump chambers 30 because multiple seal locations are formed between the gears.

As no compression action by reduction of the pump chambers is used this time, the suction and discharge ports are elongate-groove-shaped over the entirety of the side for increasing the capacity of the pump chamber and the side for reducing the capacity of the pump chamber (first port groove 41*a*1, second port groove 41*b*1) respectively. For this reason, among the seal portions separately forming each of the pump chambers, the locations where the seal properties are truly required are only the seal portions over the two locations where the port grooves end. The port grooves end at the two locations of the vicinity of the pump chamber having the largest capacity and the vicinity of the pump chamber having the smallest capacity (called as a largest pump chamber side ending portion 41*n* and a smallest pump chamber side ending portion 42*m* respectively). Therefore, it is important to improve the seal properties of the seal portion forming the pump chamber having the largest capacity and the seal portion forming the pump chamber having the smallest capacity.

As is apparent in FIG. 13, the pump chamber having the smallest capacity is the location where both gears get into each other and mate (mutually exert a force), and so contact occurs without exception and the sealing is constantly and securely performed.

It is clear from the above that the pump chamber having the largest capacity must be securely closed off. Thus, the pump chamber having the largest capacity out of the multiple pump chambers 30 is specifically called as a confinement area 30*a* in the sense that it is the area required to be securely closed off.

FIG. 13 shows an appearance of the confinement area 30*a* which moves according to the rotation of the gears. As the seal portion for forming the confinement area 30*a* involves sliding, it is called as a sliding contact portion 30*b*. The sliding contact portions 30*b* are at all tooth tips and in proximity on both sides thereof in the external gear and the internal gear (the locations denoted by reference character 30*b*' in FIG. 13 do not require the seal in a strict sense because those are on the port grooves). Thus, it has become clear that internal leakage of the internal gear pump can be reduced by improving form accuracy of these very narrow tooth tips so as to improve the pump performance.

It is extremely difficult to attain this form accuracy by machining for the aforementioned reasons because of being the internal gear type and the reversible type. According to this embodiment, the running-in coating 8 as shown in FIGS.

6 to 10 is provided on the surfaces of both gears so as to realize a high-accuracy tooth form. Next, the running-in coating 8 will be described in detail.

First, the wear-resistant running-in coating 8 as shown in FIG. 10 is provided on the sides of respective tooth tips 2*d*, 3*d* of the gears 2, 3 (refer to FIG. 8). To begin with, consideration is given to the case where interference occurs due the shape of the material itself.

In the case where no running-in coating is provided, both gears have a significant contact load exerted on the interference portion at the moment of interference so that amounts of eccentricity of both gears are increased to maintain the rotation. Consequently, their positional relation is deviated from an ideal one, and so the sliding contact portion 30*b* of the confinement area 30*a* requiring the seal gets off and the seal properties are reduced, resulting in reduced pump performance.

According to this embodiment, the running-in coating 8 is provided to the tooth tips of both gears. Therefore, the wear of the interference portion which becomes the significant contact load in continuous operation selectively progresses so that the interference is gradually avoided. Eventually, it automatically realizes, just by operating it, the tooth form of an adequate level which is extremely difficult in the case of the machining (very costly even if realized) in all mesh combinations generated by both gears so that the positional relation of the gears comes closer to the ideal. Consequently, there is the effect of gradually improving the seal properties of the sliding contact portion 30*b* and significantly improving the ultimate pump performance.

As is apparent in FIG. 10, the running-in coating 8 is characterized in that its wear resistance becomes higher as it goes inside from the coating surface. For this reason, running-in speed can be increased at an early stage of the pump operation. Therefore, there is the effect of reducing operating time in the state of little running-in, that is, the state where no tooth form correction has been performed and increasing the speed of improvement in the pump efficiency of the pump apparatus.

Furthermore, as running-in progresses, the amount of interference is reduced and the contact load is reduced to slow down wear speed, and the inside of the running-in coating comes out on the surface. Therefore, there is the effect of improving the wear resistance, preventing excessive wear and maintaining tooth form accuracy for realizing optimal mesh.

Particularly, in this case, the wear resistance continuously changes to the wear resistance of the material, and so the running-in is finished halfway through the running-in coating. Thus, there is the effect of securely avoiding the excessive wear and maintaining the tooth form accuracy for realizing the optimal mesh for a long period of time.

As the surface can wear, it is possible to set a large amount of interference allowed on assembly. Therefore, it is possible to lessen a maximum clearance which may be generated at the tooth tips in terms of tolerance. Thus, there is the effect of improving average pump performance.

Another reason for allowing this is adoption of a method of gradually fastening the cover screw 61*s* while rotating the drive shaft 4 on assembling the housing 1 for housing the gears. It is thereby possible to already start the running-in and perform the tooth form correction in this assembly stage. Therefore, it becomes possible to perform assembly even in a combination which cannot not be assembled in a state of no running-in.

While a force for driving the internal gear for dependently rotating is exerted on the seal portion on a smallest pump chamber side ending portion 41*p*, no significant load is exerted on the seal portion (sliding contact portion 30*b*) on the largest pump chamber side ending portion 41*n* which is the most important seal portion. Therefore, no excessive wear occurs even if the running-in coating 8 which is easy to wear in comparison to the material is provided so that there is the effect of maintaining the tooth form accuracy for realizing the optimal mesh for a long period of time.

Next, the running-in coating 8 with the wear resistance as shown in FIG. 10 is provided on respective side faces 2*c*, 3*c* of the gears 2, 3 (see FIG. 9). As its surface can wear, it is possible to set a large amount of interference to be allowed at the time of assembly. Therefore, it is possible to lessen the maximum clearance which may be generated on the side portions in terms of tolerance. Thus, there is the effect of improving the average pump performance.

Another reason for allowing this is adoption of a method of gradually fastening the cover screw 61*s* while rotating the drive shaft 4 when assembling the housing 1 for housing the gears. It is thereby possible to already start the running-in and perform the tooth form correction in this assembly stage. Therefore, it becomes possible to perform the assembly even in a combination which can not be assembled in the state of no running-in.

It is also possible to lessen the maximum clearance that may be generated on the side portions. Thus, there is the effect of suppressing the stagger of the gears in conjunction with the rotation, reducing the collisions with the housing bottom and the top surfaces or the other gear, and lessening the oscillation noise.

Next, the running-in coating 8 is provided on a peripheral surface 2*g* and a tooth bottom face 2*e* of the internal gear 2. Thus, the running-in coating is formed on the entire surface of the internal gear 2 so that there is no longer a location having no running-in coating thereon. Thus, there is the effect of requiring no masking and easily allowing mass production. Furthermore, it is possible, as before, to lessen the maximum clearance which may be generated on the gear peripheral surface and the tooth bottom face in terms of tolerance. Thus, there is the effect of suppressing the internal leakage (improving the seal properties on the smallest pump chamber side ending portion 41*p* as to the tooth bottom face) and improving the average pump performance.

Next, the running-in coating 8 is provided on a tooth bottom face 3*e* of the external gear 3. It is possible, as before, to lessen the maximum clearance which may be generated on the tooth bottom face of the gear in terms of tolerance. Thus, there is the effect of suppressing the internal leakage (improving the seal properties on the smallest pump chamber side ending portion 41*p* with respect to the tooth bottom face) and improving the average pump performance.

According to this embodiment, the running-in coating 8 is provided to both gears. It is thereby possible to achieve the tooth form close to the optimal one. For the sake of this description, consideration is given to the case of providing the running-in coating 8 only to the gear on one side. As the number of teeth is different just by one between the internal gear 2 and the external gear 3, each individual tooth of the gear with the running-in coating 8 is worn away by all teeth of the gear without running-in coating 8. For this reason, a running-in form of the tooth of the most significant interference becomes an eventual form, and the clearance is definitely enlarged on meshing with the other teeth. In the case of providing the running-in coating on both gears, it is worn away by the tooth of the most significant interference in the early stage of the running-in. As the interfering teeth are selectively worn away thereafter, however, the difference in the amount of interference is reduced so that there is the effect of enhancing the seal properties and improving the pump performance in all combinations in the eventual running-in form.

As for the case where the wear resistance of the running-in coating 8 continuously changes according to depth of the coating and eventually reaches the wear resistance of the material (FIG. 10) as in this embodiment, it can be realized by reforming the material surface to have a running-in property by chemical reaction or the like rather than attaching a new coating to the material surface. Such a type has no discontinuous surface such as a bonding surface, and so there is the effect of high reliability because there is very little danger of exfoliation of the coating and the like.

As previously mentioned, no significant load is exerted on the sliding contact portion 30*b* of the confinement area 30*a* which is the most important seal portion so that, even if the running-in coating 8 which easily wears away is provided, no excessive wear occurs and there is the effect of maintaining the tooth form accuracy for realizing the optimal mesh for a long period of time. However, this load also has the action to suppress a mutual collision of the gears if it is somehow triggered (it occurs in the sliding contact portion as a matter of course). For this reason, excessive load reduction results in continuation of the collision, which inversely promotes the wear of the sliding contact portion.

Thus, in order to avoid the danger, a means for mutually biasing the sliding contact portions 30*b* in the confinement area (a confinement area biasing means) described below are provided. The biasing means are discharge pressure lead-in radial grooves 41*d*1, 41*d*2 as shown in FIG. 3.

The discharge pressure lead-in radial grooves 41*d* are provided at the positions connecting the port grooves 41*a* with the peripheral surface 2*g* of the internal gear 2 respectively. Each of those leads high-pressure hydraulic oil from the port groove on the high pressure side to the peripheral surface of the internal gear 2, which flows on the peripheral surface by a short distance (confinement area side) to the other discharge pressure lead-in radial groove and then flows into the port groove through the discharge pressure lead-in radial groove. The internal gear of the port on the high pressure side originally has the high-pressure hydraulic oil leaked on the periphery thereof, and so the internal gear 2 is pressed toward the port on the low pressure side. Consequently, average pressure of the hydraulic oil led to the periphery of the internal gear by the radial groove becomes higher because the channel becomes narrower as it gets closer to the low pressure side. It is consequently possible to introduce the high-pressure hydraulic oil to the periphery on the confinement area side of the internal gear by means of the discharge pressure lead-in radial groove 41*d* so as to allow a force in the direction for biasing the sliding contact portion (biasing force) to be exerted.

Second Embodiment

Figure 14:
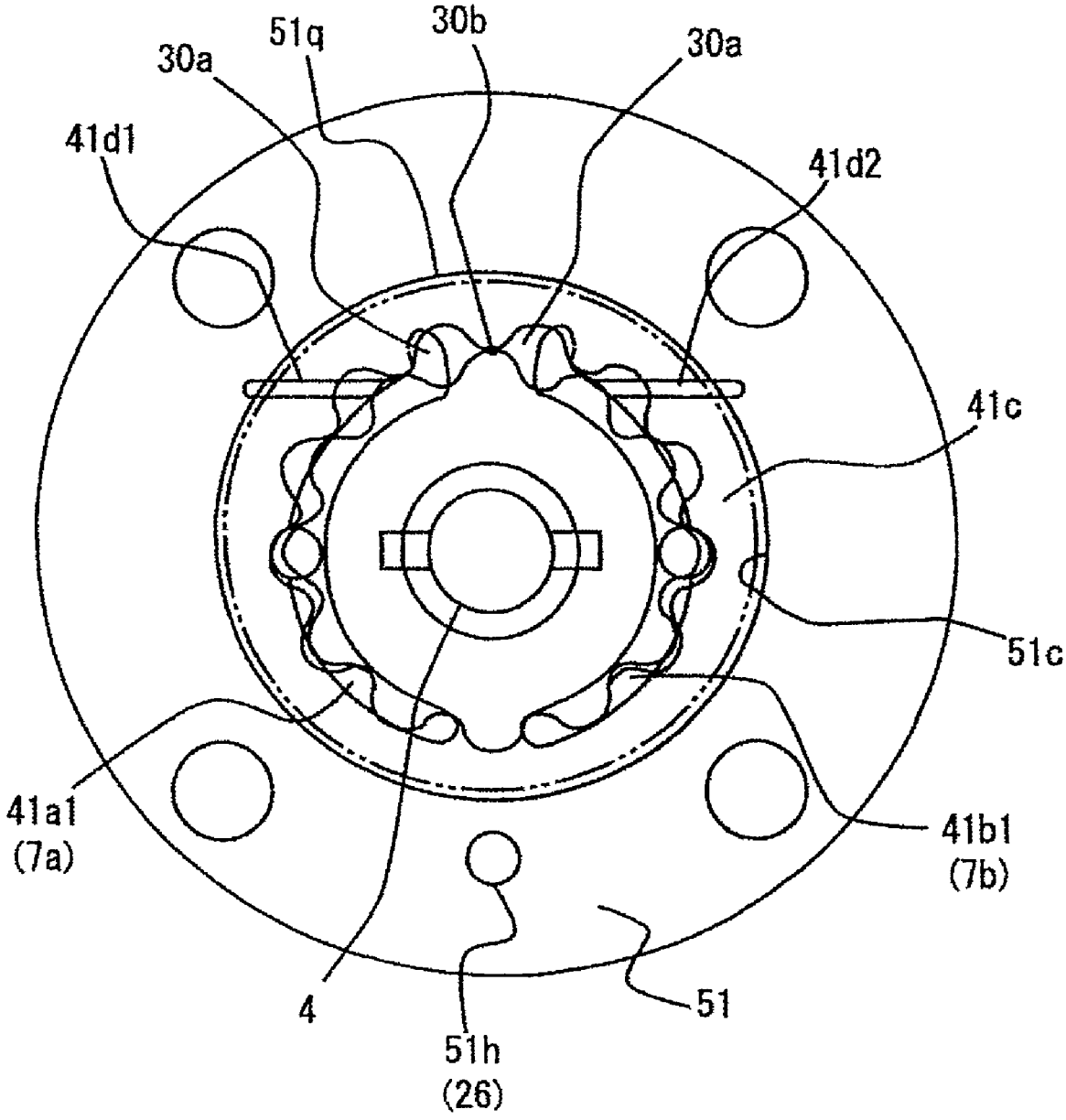
FIG. 14 is an explanatory diagram of a biasing means of an internal gear of a power pack according to a second embodiment.

Next, a second embodiment of the present invention will be described by using FIG. 14.

This embodiment is the same as the first embodiment except that a discharge pressure lead-in circumferential groove 51*q* is provided on the housing case 51. Therefore, a description of the configuration and the effects other than those related to the circumferential groove 51*q* will be omitted.

The discharge pressure lead-in circumferential groove 51*q* leads the high-pressure hydraulic oil from the port groove on the high pressure side to the peripheral surface of the internal gear 2. Thereafter, the flow passing along the peripheral surface on the confinement area side is made sure, and the high-pressure hydraulic oil can be securely introduced to the periphery on the confinement area side of the internal gear 2 so as to allow a force in the direction for biasing the sliding contact portion (a biasing force) to be securely exerted. Thus, it realizes the ultimate high pump performance in a short time by increasing the speed of running-in and secures stable sliding so that there is the effect of avoiding the excessive wear of the sliding contact portion and improving the reliability.

Third Embodiment

Figure 15:
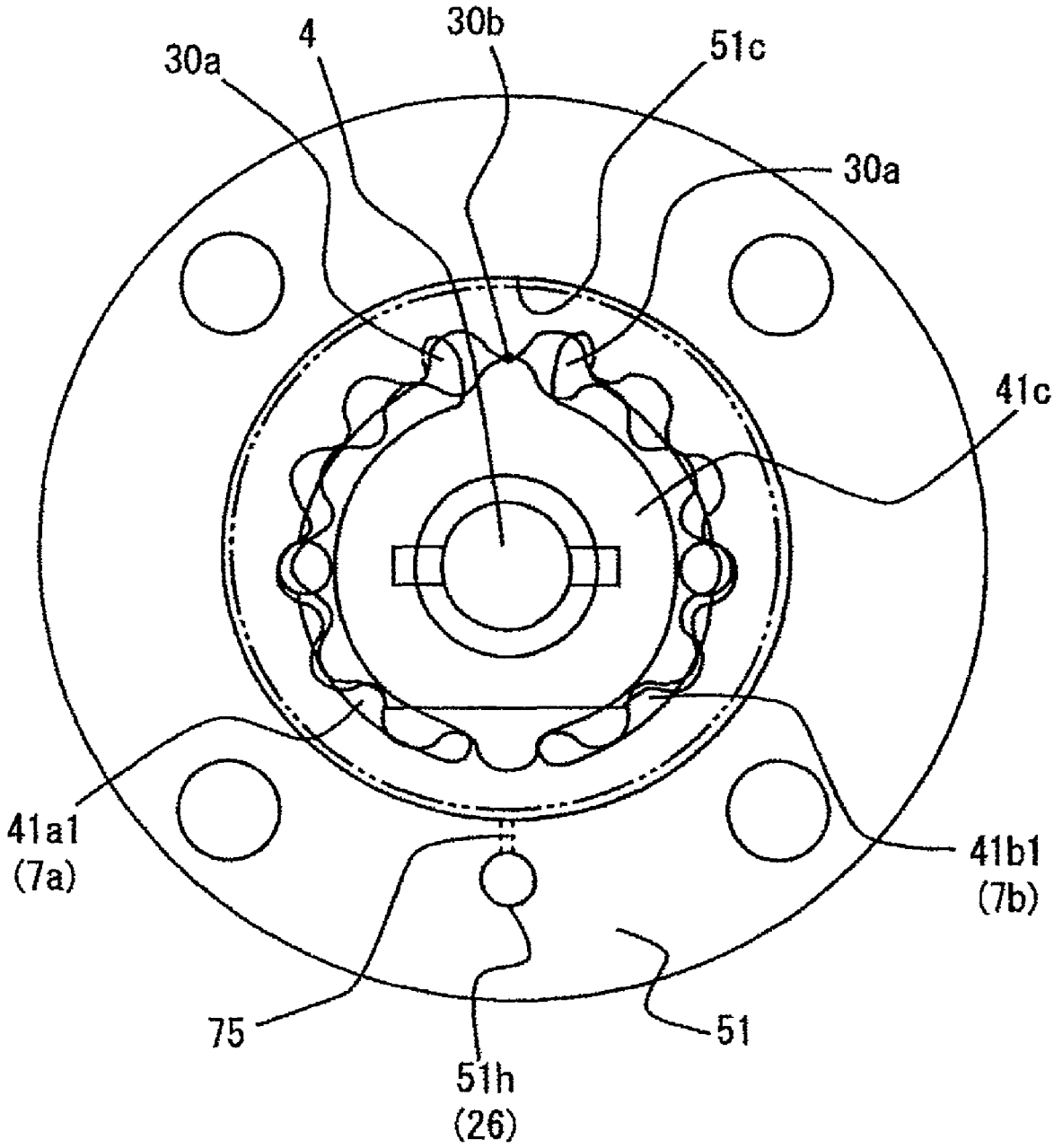
FIG. 15 is an explanatory diagram of a biasing means of an internal gear of a power pack according to a third embodiment.

Next, a third embodiment of the present invention will be described by using FIG. 15.

This embodiment is the same as the aforementioned first embodiment except that a low pressure lead-in path 75 is provided on the smallest pump chamber side ending portion 41*p* side. Therefore, a description of the configuration and the effects other than those related to the low pressure lead-in path will be omitted.

As the low pressure lead-in path 75 is a channel for connecting the oil-drain circuit 26 which is constantly at the lowest pressure in the pump apparatus (except the reservoir tank 20) with clearance space of the peripheral surface of the internal gear 2. Therefore, there arises an oil flow such that the hydraulic oil leaked out to the clearance space from the pump chamber passes through this channel and flows out to the oil-drain circuit 26. Here, channel resistance is high because the low pressure lead-in path 75 is a restriction channel, and the pressure lowers in an appropriate area on the smallest pump chamber side ending portion 41*p* side where the low pressure lead-in path is opened in the clearance space of the peripheral surface of the internal gear.

Consequently, the internal gear 2 is pulled to the smallest pump chamber side ending portion 41*p* side to allow a moderate biasing force to be exerted on the sliding contact portions 30*b*. Thus, it realizes the ultimate high pump performance in a short time by increasing the speed of running-in and secures stable sliding so that there is the effect of avoiding the excessive wear of the sliding contact portion and improving the reliability. Here, the low pressure lead-in path 75 may take either form of a fine pore of the housing case 51 or a shallow groove on the top surface of the housing base 41.

Fourth Embodiment

Next, a fourth embodiment of the present invention will be described by using FIGS. 16 and 17. This embodiment is the same as the first to third embodiments except that the running-in coating 8 is a type which accompanies a running-in precipitate layer on the outside rather than on a raw material surface. Therefore, a description of the configuration and the effects other than those related to the running-in coating will be omitted.

Figure 16:
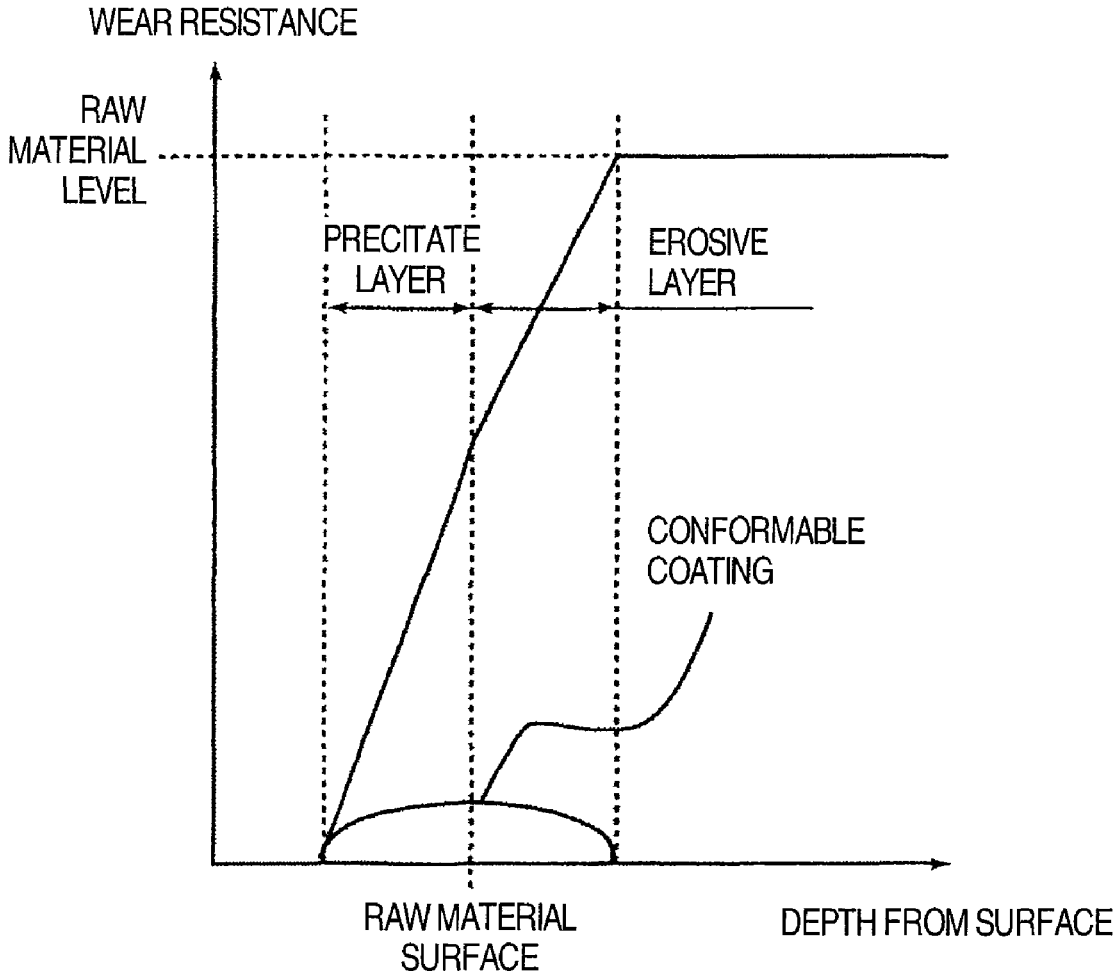
FIG. 16 is an explanatory diagram of wear resistance of a running-in coating provided on a surface of an external gear or an internal gear of a power pack according to a fourth embodiment.
Figure 17:
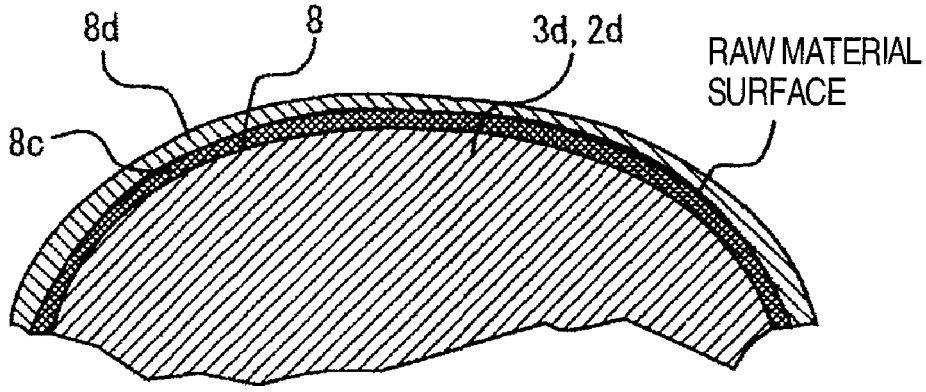
FIG. 17 is a cross section of the external gear or the internal gear of the power pack according to the fourth embodiment.

As shown in FIG. 16, a layer (a running-in precipitate layer 8*d*) which precipitates further outside than that at the time of the raw material has such a high running-in property that it is easily worn away by the interference and the like. For this reason, even in the case of a combination of the gears which already has a clearance in dimension of the raw material, it is possible to fill the clearance because of the precipitate layer. As for a clearance like a concave portion, no load is exerted so that the sealing action can be sufficiently exercised even to a layer easily worn away. In the case where the material is a sintered material for instance, it is especially effective because minute pits exist on its surface and the seal properties can be improved by burying such portions.

By the above, there is the effect of improving the seal properties of the sliding contact portion and further improving the pump performance. In the case of considering the combination of the gears, it becomes possible to consider merely based on central dimensions, and there is the effect of facilitating management of member dimensions on mass production.

As for a practical embodiment of such a coating, a manganese phosphate coating can be raised in the case where the raw material is iron. There is a degreasing process in the early stage of the running-in coating formation process. However, in the case where the material is a porous material such as a sintered material, the degreasing by a normal method may become difficult if the oil gets into the holes. Thus, it is considered effective to perform ultrasonic cleaning.

Fifth Embodiment

Figure 18:
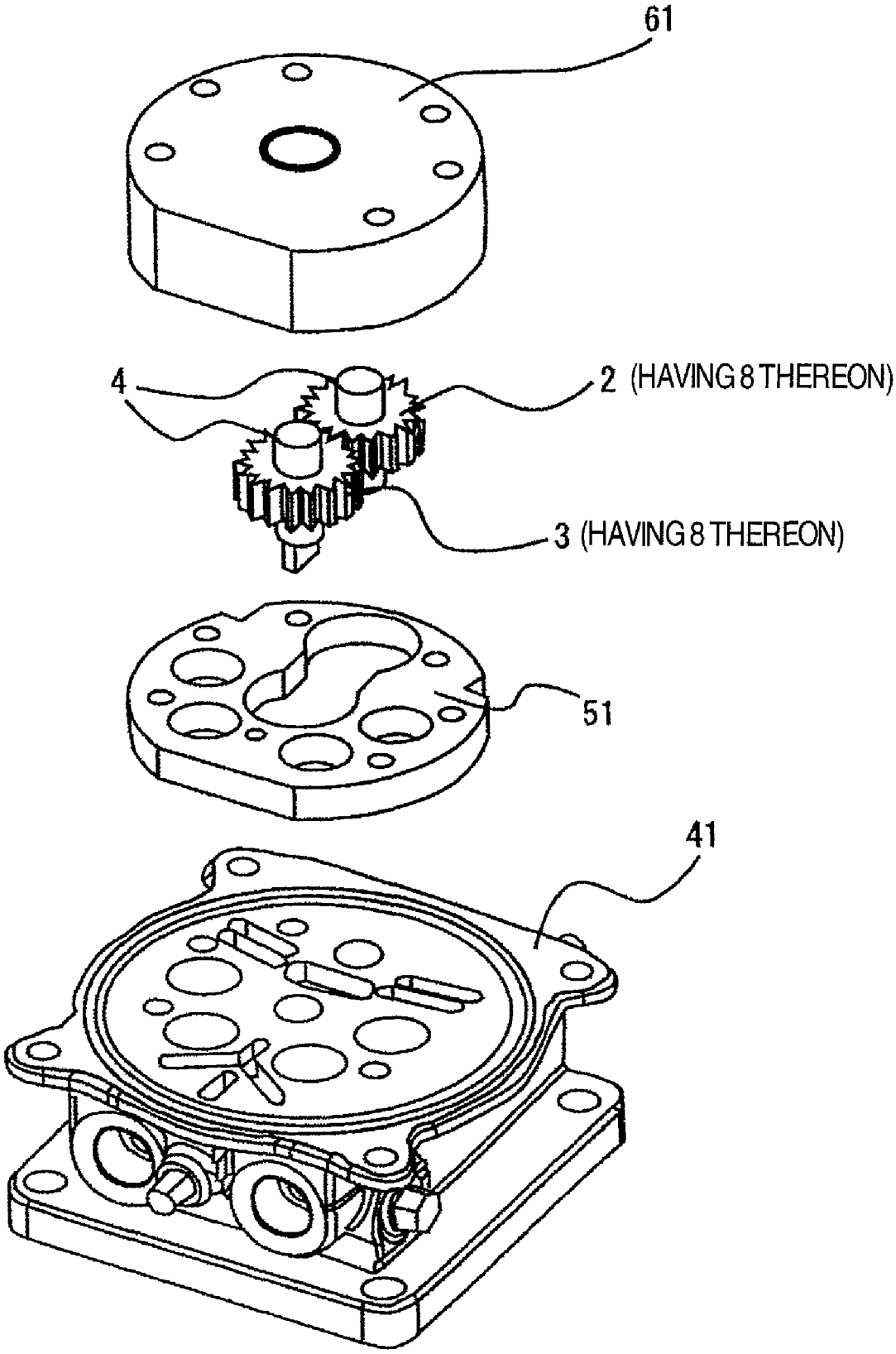
FIG. 18 is an explanatory diagram of a configuration of an external gear type pump apparatus of a power pack according to a fifth embodiment.

Next, a fifth embodiment of the present invention will be described by using FIG. 18. This embodiment has the same steering system configuration and placement of the elements except that the gears of the pump portion are changed from the internal type to the external type. Therefore, a description of the configuration and the effects other than those of the gears 2, 3 will be omitted.

The locations which require the seal are the locations where the seal properties are automatically kept by the mesh of the gears (seal length depending on thickness of the gears is short because the gears are thin, and so it is easy to keep the seal properties), the inner periphery of the housing case 51 and the locations between the tooth tips of the gears. Basically, no force is exerted on the latter. Therefore, if the running-in coating 8 is provided on the surfaces of the teeth, the tooth tips become optimal-shaped just by performing the operation so that the clearance of the inner periphery of the housing case and the gears can be minimized. As no load is exerted on the seal locations, excessive running-in does not progress. Therefore, there is the effect of realizing a pump apparatus of low cost and long-term high performance and consequently a high-performance steering using it.

All embodiments described so far are the cases where the running-in coating is provided to both gears. However, it may also be just one side as a matter of course. In this case, there is the effect of reducing the cost for forming the running-in coating. As for the seal location where the force of the mesh is hardly exerted, such as the seal location on the confinement area side of the internal gear pump, in the case where the running-in coating is provided on both gears and is put in a severe use environment such as continuously performing intensive changeovers in the early stage of the running-in, there is a danger, though a little but still remaining because of a high degree of freedom of form correction, that irregular early-stage running-in occurs and causes an eventual running-in form to slightly deviate from the adequate form. If the running-in coating is only provided on one side of the gear, the degree of freedom of form correction can be adequately controlled so that there is the effect of avoiding the danger.

As for the embodiments, it is not impossible to exert the biasing force for enhancing a contact force of the tooth tips on the gear on the driving side. However, it is desirable to exert the biasing force on the gear on the non-driving side because there are problems such as the apparatus becoming complex and larger-size. In the case of the internal gear pump for instance, it is good to exert on the internal gear 2 the biasing force in the direction for pressing the tooth tips of the internal gear 2 against the tooth tips of the external gear 3.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A pump apparatus comprising:

a housing;

a first gear rotatably housed inside the housing;

a second gear rotatably housed inside the housing and engaged with the first gear;

a drive shaft for driving and rotating at least one of the first gear and the second gear;

a suction port formed in the housing and opened in an area where hydraulic oil is sucked by rotation of the first gear and the second gear; and a discharge port formed in the housing and opened in an area where the hydraulic oil is discharged by the rotation of the first gear and the second gear, wherein the first gear is an internal gear having internal teeth on an inner periphery side, the second gear is an external gear provided on the inner periphery side of the internal gear in a rotatable state and having external teeth on an outer periphery side, the external teeth being enraged with the internal teeth, the drive shaft is provided on the external gear to drive and rotate the external gear, at least one of the internal gear and the external gear has a running-in coating in a portion where a tooth of the internal gear and a tooth of the external gear contact with each other in a sliding state, at least in a confinement area in which the hydraulic oil is confined between the internal gear and the external gear, the confinement area being a chamber having the largest capacity among a plurality of pump chambers formed between the internal gear and the external gear, and a biasing means for moving at least one of the internal gear and the external gear, wherein at least one of the internal gear and the external gear is moved in a direction in which a contact force between tooth tips of the internal gear and the external gear is enhanced is provided in the portion where the tooth of the internal gear and the tooth of the external gear contact with each other in a sliding state in the confinement area.

2. The pump apparatus according to claim 1, wherein the biasing means is a low pressure providing means for introducing low pressure which is substantially the same as suction pressure over a predetermined angular area opposed to the confinement area and between an inner periphery surface of the housing and the internal gear.

3. The pump apparatus according to claim 1, wherein the biasing means is a high pressure providing means for introducing high pressure which is substantially the same as discharge pressure over a predetermined angular area including the confinement area and between an inner periphery surface of the housing and the internal gear.

4. The pump apparatus according to claim 1, wherein the pump apparatus is a bidirectional pump in which the drive shaft rotates normally and reversely.

5. A power steering comprising:

a hydraulic cylinder for assisting a steering force of a steering mechanism (a rack-and-pinion and the like) linked to a steering wheel;

a pump for supplying fluid pressure to a pressure chamber of the hydraulic cylinder;

an electric motor for driving the pump;

a steering torque detection means for detecting steering torque of the steering mechanism; and a motor control circuit for outputting a drive command signal to the electric motor based on the steering torque detected by the steering torque detection means, wherein the pump includes:

a housing;

an internal gear rotatably housed inside the housing and having internal teeth on an inner periphery side;

an external gear rotatably provided on the inner periphery side of the internal gear and having external teeth on an outer periphery side, the external teeth being engaged with the internal teeth;

a drive shaft connected to the external gear for to drive and rotate the external gear;

a suction port opened in a suction area where the capacity of a pump chamber is increased according to rotation of the drive shaft among a plurality of pump chambers formed between the internal teeth of the internal gear and the external teeth of the external gear;

means for providing biased movement of at least one of the external and the internal gear to provide advanced contact force in a confinement area having the largest capacity among the pump chambers; and a discharge port opened in a discharge area where the capacity of the pump chamber is decreased according to the rotation of the drive shaft among the plurality of pump chambers, wherein at least one of the external gear and the internal gear has a running-in coating on a sliding contact peripheral surface of a tooth tip portion, wherein high pressure which is substantially the same to discharge pressure is introduced over a predetermined angular area including the confinement area and between an inner periphery surface of the housing and the internal gear.

* * * * *